US011105109B2

(12) United States Patent
Durvasula et al.

(10) Patent No.: US 11,105,109 B2
(45) Date of Patent: Aug. 31, 2021

(54) SELF-PROPELLED ROBOTIC POOL CLEANER AND WATER SKIMMER

(71) Applicant: ZODIAC POOL SYSTEMS LLC, Carlsbad, CA (US)

(72) Inventors: Kameshwar Durvasula, Garfield, NJ (US); Ethan Hanan, Teaneck, NJ (US); Anthony Meletta, Little Falls, NJ (US); William Londono, Wayne, NJ (US); Aleksandr Klebanov, Bloomfield, NJ (US)

(73) Assignee: ZODIAC POOL SYSIEMS LLC, Carlsbad, CA (US)

( * ) Notice: Subject to any disclaimer, the term of this patent is extended or adjusted under 35 U.S.C. 154(b) by 0 days.

(21) Appl. No.: 16/925,564

(22) Filed: Jul. 10, 2020

(65) Prior Publication Data

US 2020/0347630 A1 Nov. 5, 2020

Related U.S. Application Data

(63) Continuation of application No. 15/819,765, filed on Nov. 21, 2017, now Pat. No. 10,738,495.

(Continued)

(51) Int. Cl.
*E04H 4/16* (2006.01)
*F04D 29/70* (2006.01)

(Continued)

(52) U.S. Cl.
CPC ..... *E04H 4/1654* (2013.01); *E04H 4/1263* (2013.01); *F04D 29/708* (2013.01); *F04D 13/06* (2013.01); *F04D 29/18* (2013.01)

(58) Field of Classification Search
CPC ... E04H 4/1654; E04H 4/1263; F04D 29/708; F04D 29/18; F04D 13/06

(Continued)

(56) References Cited

U.S. PATENT DOCUMENTS 2,923,954 A * 2/1960 Babcock ..... A47L 7/0009 15/1.7
3,868,739 A * 3/1975 Hargrave ..... E04H 4/1636 15/1.7

(Continued)

FOREIGN PATENT DOCUMENTS

EP 1070850 1/2001
EP 3012386 4/2016

OTHER PUBLICATIONS

U.S. Appl. No. 15/819,765, Ex Parte Quayle Action dated Feb. 26, 2020, 5 pages.

(Continued)

*Primary Examiner* — Fred Prince
(74) *Attorney, Agent, or Firm* — Kilpatrick Townsend & Stockton LLP; Dean W. Russell

(57) ABSTRACT

A robotic pool cleaner can operate while submerged to clean floor and side wall surface areas of the pool. A second embodiment of the pool cleaner can clean debris while skimming water along the top surface of the pool water. A third embodiment of the pool cleaner when inverted from submerged cleaning mode into skimmer mode, exposes on its bottom surface solar panels by which the pool cleaner's internal batteries can be recharged. A fourth embodiment of the pool cleaner includes different combinations of the submerged cleaning mode, the skimming mode and the battery charging mode.

6 Claims, 17 Drawing Sheets

Related U.S. Application Data

(60) Provisional application No. 62/425,411, filed on Nov. 22, 2016.

(51) Int. Cl.
*F04D 29/18* (2006.01)
*F04D 13/06* (2006.01)
*E04H 4/12* (2006.01)

(58) Field of Classification Search
USPC ..... 210/167.16, 167.17, 143; 15/1.7
See application file for complete search history.

(56) References Cited

U.S. PATENT DOCUMENTS

| | | | | |
|---|---|---|---|---|
| 5,044,034 | A | 9/1991 | Iannucci | |
| 5,285,547 | A | 2/1994 | Sebor | |
| 5,613,261 | A | 3/1997 | Kawakami et al. | |
| 8,393,036 | B2 | 3/2013 | Mastio et al. | |
| 8,438,684 | B2 | 5/2013 | Mastio et al. | |
| 9,267,300 | B2 | 2/2016 | Mastio et al. | |
| 10,738,495 | B2 | 8/2020 | Durvasula et al. | |
| 2002/0116772 | A1* | 8/2002 | Phillipson | E04H 4/1663 15/1.7 |
| 2003/0201218 | A1 | 10/2003 | Henkin et al. | |
| 2005/0166355 | A1 | 8/2005 | Tani | |
| 2006/0102532 | A1 | 5/2006 | Cadotte | |
| 2006/0104720 | A1 | 5/2006 | Haski et al. | |
| 2007/0251032 | A1* | 11/2007 | Pichon | E04H 4/1654 15/1.7 |
| 2010/0058546 | A1* | 3/2010 | Erlich | E04H 4/1654 15/1.7 |
| 2011/0162683 | A1 | 7/2011 | Mastio et al. | |
| 2013/0146106 | A1* | 6/2013 | Erlich | E04H 4/1663 134/34 |
| 2014/0263087 | A1 | 9/2014 | Renaud et al. | |
| 2016/0060887 | A1 | 3/2016 | Tryber et al. | |
| 2018/0073266 | A1 | 3/2018 | Goldenberg et al. | |
| 2018/0187442 | A1 | 7/2018 | Durvasula et al. | |

OTHER PUBLICATIONS

U.S. Appl. No. 15/819,765, Non-Final Office Action dated Oct. 16, 2019, 9 pages.
U.S. Appl. No. 15/819,765, Notice of Allowance dated Apr. 29, 2020, 7 pages.
U.S. Appl. No. 15/819,765, Applicant-Initiated Interview Summary dated Dec. 16, 2019, 4 pages.
European Application No. EP17203085.0, Notice of Decision to Grant dated Dec. 12, 2019, 2 pages.
European Application No. EP17203085.0, Extended European Search Report dated Apr. 24, 2018, 7 pages.

* cited by examiner

HIGH LEVEL BLOCK DIAGRAM

SELF-PROPELLED ROBOTIC POOL CLEANER AND WATER SKIMMER

CROSS-REFERENCE TO RELATED APPLICATION

This application is a continuation of allowed U.S. patent application Ser. No. 15/819,765, filed Nov. 21, 2017, which claims priority to U.S. Provisional Patent Application Ser. No. 62/425,411, filed Nov. 22, 2016, the entire contents of both of which applications are incorporated herein by this reference.

TECHNICAL FIELD

This invention relates to self-propelled robotic pool cleaners which can clean floor and wall surfaces while submerged in a pool, and to pool cleaners configured to skim debris while being propelled along the top surface of the pool water.

BACKGROUND AND PRIOR ART

1. Field of the Invention

The present invention relates to robotic pool cleaners and more specifically to cleaning the submerged bottom and side surface areas of the pool, and skimming water along the top surface of the pool water.

2. Related Prior Art

Self-propelled robotic pool cleaners are used to clean debris from the submerged bottom and side wall surfaces of a swimming pool or tank. For example, U.S. Pat. No. 8,393,036 illustratively describes a self-propelled robotic pool cleaner that cleans a bottom surface of a pool in random directions. Although debris along the bottom surface of the pool may be removed by the robotic pool cleaner, any debris floating at the top surface of the pool water cannot be removed by the cleaner. Rather, the floating debris is typically filtered from the water by an above-ground pool cleaning system of the pool. The above-ground cleaning systems generally include a skimmer built into or otherwise located along the sidewall of the pool proximate the top surface of the water for collecting the pool water and debris, a filter basket for separating and retaining the debris entrained in the water, an external pump for drawing the water into the skimmer and the filter, and then pumping the filtered water back into the pool. A drawback of the above-ground cleaner is the time that it takes for the floating debris to reach the skimmer and be filtered out of the water. Attempts to improve the cleaning process include angling or directing the above-ground pump water outlets or nozzles in a predetermined direction to produce a water jet in the pool to better circulate the pool water. However, floating debris still takes considerable time to finally reach the skimmer. Accordingly, it would be advantageous to have a self-propelled robotic pool cleaner that can clean along the bottom and sidewalls of a pool and also assist with the filtering of debris floating along the surface of the pool water.

SUMMARY AND OBJECTS OF THE PRESENT INVENTION

A first object of the present invention is to provide a novel pool cleaner having various capabilities including, but not limited to, cleaning and filtering pool water while it is traveling at the bottom surface of the pool in a generally horizontal orientation; cleaning and filtering pool water while it is traveling in a generally vertical orientation along a sidewall surface of the pool; and inverting itself while at the water surface so as to float on the water surface for purposes of (i) skimming floating debris while propelling itself along the top surface of the pool water, and (ii) where power to the cleaner is provided via on-board rechargeable batteries, capturing sunlight via solar panels positioned along its inverted bottom surface to recharge the internal batteries.

A further object is to provide a self-propelled robotic pool cleaner that can change its orientation from upright while moving on the bottom surface of the pool by turning up to ninety degrees to climb a sidewall of the pool, and rotate again to assume an inverted position while floating on the water's surface.

It is thus an object to provide a self-propelled robotic pool cleaner that can move or otherwise paddle across the top surface of the pool water to filter debris entrained in or floating on top of the water.

A further object is to provide a self-propelled robotic pool cleaner that includes one or more rechargeable batteries positioned within the cleaner housing.

It is a further object to provide a self-propelled battery operated pool cleaner that can recharge its own batteries when it reaches the water surface by inverting itself to expose its bottom surface solar panels to sunlight.

Another object is to provide a robotic self-propelled battery operated pool cleaner that can draw pool water in through its bottom surface intake ports when oriented upright at the pool bottom, and can draw pool water in through its lateral intake ports when oriented upside down and filtering at the water surface and while in battery recharging mode.

A further object is to provide a robotic self-propelled battery operated pool cleaner that can by itself change orientation from upright when on the bottom of the pool to turn ninety degrees upward (e.g.) to climb the pool wall, and then turn another ninety degrees to an inverted orientation when at the water surface for exposing its bottom surface panels to sunlight for recharging.

An additional object is to provide a robotic self-propelled pool cleaner that can climb a vertical (or other upward extending) wall and invert itself when it senses that its intake port on its bottom surface reaches above water level and draws in air instead of water.

A still further object is to provide a robotic self-propelled pool cleaner which, in a skimming mode of operation on the water surface, can traverse and filter pool water and can sense low battery charges and cease or reduce skimming operations until its solar cells have adequately recharged the pool cleaner's batteries.

Another object is to provide a robotic self-propelled pool cleaner with an onboard computer for programmed operation for travel path of the pool cleaner while cleaning the submerged surfaces along the bottom and sidewalls of the pool, and/or during the water surface skimming mode of operation, and/or during sunlight battery-charging mode of operation.

A further object is to maintain the bottom surface intake open and lateral intakes closed while the pool cleaner is upright and traversing the bottom or sidewalls of a pool, and to close the bottom surface intake and open the side intakes while the pool cleaner is inverted and traversing the water at the surface of the pool.

Another object is to provide within a pool cleaner housing a drive mechanism for moving a weight from a lower region upward, to thereby move the center of gravity upward, to induce the housing to rotate, e.g., approximately ninety degrees around its longitudinal axis into wall climbing mode, and to later move the center of gravity further upward to induce the housing to rotate again (e.g., another ninety degrees) into its inverted orientation for the skimming and/or recharging mode. Alternatively, a trackable weight mounted in the pool cleaner housing is rotated relative to the housing to thereby change the orientation of the pool cleaner from upright, to horizontal, to inverted, such trackable weight being moved by gears driven by the motor which can be powered by the cleaning device's battery.

In still another embodiment, the housing contains a buoyant member joined to a drive mechanism to change the location of said buoyant member to a lower region within the housing, for example, to induce the housing to rotate about its horizontal axis, as described above for wall-climbing and operation in the inverted skimmer modes. The drive mechanism is preferably powered by the onboard batteries and will be activated, e.g., by the on-board computer, or by a timer or by one or more sensors for detecting the position of the cleaner relative to a wall, the surface of the wall, or at an angular displacement from a horizontal and/or vertical orientation.

A still further object is to provide on the self-propelled robotic pool cleaner, rotational supports such as wheels or tracks for propulsion by friction drive on the bottom and sidewall surfaces, and to provide paddle-like propulsion at the surface water level while skimming. This friction drive on the pool bottom and up the sidewalls is achieved by the discharge of the pressurized stream of water from the top which has the effect of pushing the housing toward the bottom or sidewall surface, respectively, while the wheels or tracks are moving the unit forward and/or upward.

Another object is to provide a self-propelled robotic pool cleaner as described above to be operable with both battery power and/or external power provided by a power cable.

A further object is to provide a self-propelled robotic pool cleaner as described above which has means for sensing its orientation such as being upright, being rotated approximately ninety degrees while climbing a sidewall of the pool, and/or inverted and providing such information to the onboard computer.

A still further object is to provide a self-propelled robotic pool cleaner as described above which has in its inverted skimming mode means for sensing when there is adequate sunlight for recharging the onboard batteries and communicating such information to the onboard computer, which may allow simultaneous skimming and recharging, or may cease skimming to maximize charging efficiency.

Additional objects are presented as various embodiments described below.

Embodiment 1. A self-propelled robotic pool cleaner comprising:

a. a housing having a first intake port in a lower surface of said housing, a second intake port in a side surface of said housing, and a discharge port in an upper surface of said housing, and having upright and inverted orientations;

b. an electric motor mounted in said housing;

c. a water pump mounted in said housing coupled to said electric motor and outputted to and through said discharge port;

d. an onboard programmable micro-controller powered by said battery and directing said pool cleaner between a first operation mode where said housing is in a first orientation that is propelled below water level on floor and wall surfaces of a pool, and a second operation mode when said housing is inverted to an inverted orientation for skimming along the top surface of the water;

e. rotationally-mounted supports driven by said electric motor (i) propelling said housing on said pool floor and up said pool wall surfaces and upward to water level while in said first operation mode, and (ii) paddling said housing while in said second operation mode; and f. an inverter that inverts said housing from said first orientation while in said first operation mode to an inverted orientation when said housing has risen to water level to proceed said second operation mode.

Embodiment 2. The pool cleaner according to Embodiment 1 wherein in said first operation mode said controller closes said second intake port and opens said first intake port, whereby pool water is drawn in by said water pump through said first intake port and pumped out through said discharge port, and in said second operation mode said controller closes said first intake port and opens said second intake port, whereby pool water is drawn in by said pump through said second intake port and pumped out through said discharge port.

Embodiment 3. The pool cleaner according to Embodiment 1 further comprise comprising a rechargeable battery mountable in said housing.

Embodiment 4. The pool cleaner according to Embodiment 3 further comprising a solar panel situated on a lower outer surface of said housing and electrically coupled to said rechargeable battery, wherein when said housing is in said inverted orientation and in said second operation mode, said solar panel is facing generally upwardly to receive and convert available sunlight into electrical current that recharges said rechargeable battery.

Embodiment 5. The pool cleaner according to Embodiment 1 operable with a water filter, where said housing further comprises an interior chamber in which is situated said pump and said filter, and where said first and second intake ports and said discharge port are in fluid communication with said interior chamber, wherein pool water drawn in through either of said first and second intake ports is pumped by said water pump through said internal chamber and said filter therein and discharged out of said discharge port.

Embodiment 6. The pool cleaner according to Embodiment 1 where said inverter comprises an assembly directed by said controller to alter the center of gravity of said housing, causing said housing to change its first orientation from generally upright to said inverted orientation with its lower side facing generally upward.

Embodiment 7. The pool cleaner according to Embodiment 1 where said housing in said first orientation has upper and lower regions, and said inverter assembly comprises a buoyant element, a second electric motor and a drive element powered by said second electric motor that moves said buoyant element from said upper region to said lower region of the housing causing said housing when submerged and with said housing buoyancy inverted, to tip over to said inverted orientation.

Embodiment 8. The pool cleaner according to Embodiment 1 wherein in said first operation mode said housing is propelled along said pool floor and wall surfaces by said rotationally mounted supports, with friction between said rotationally mounted supports and said pool wall surfaces enhanced by pool water being discharged through said discharge port in said upper surface of said housing in a direction away from said wall surface, and by suction of the housing toward the wall surface as pool water is suctioned into said first intake port.

Embodiment 9. The pool cleaner according to Embodiment 1 where said inverter assembly has a first phase where said housing is tipped approximately ninety degrees and said housing can climb upward on a pool wall, and a second phase where said housing is tipped another ninety degrees into said inverted orientation.

Embodiment 10. The pool cleaner according to Embodiment 1 where said rotationally mounted supports comprise a set of wheels that are mounted rotationally about a central axis that extends through said housing and are coupled to said electric motor, and said inverter further comprises a ring gear freely rotatably mounted about said central axis and having a predetermined weight fixed to said ring gear at a location near the outer periphery thereof, said inverter further comprising a second electric motor powered by said battery and coupled to a pinion gear rotatably mounted to said housing and engaging said gear wheel, where said housing orientation is changeable from one orientation to another orientation when said controller directs said pinion gear to rotate and climb up said ring gear until said housing coupled to said pinion gear has reached a changed orientation, said ring gear tending to remain unrotated because any force developed by said weight on said periphery of said ring gear multiplied by its moment arm is greater than or equal to any counter-rotative force developed by said rotation of said housing from said climbing of said pinion gear mounted to said housing on said ring gear teeth.

Embodiment 11. The pool cleaner according to Embodiment 1, further comprising a sensor coupled to said controller, said sensor configured to sense when said housing approaches or contacts an underwater pool water surface, after which said controller directs said pool cleaner to continue movement along a predetermined travel pattern.

Embodiment 12. The pool cleaner according to Embodiment 1 further comprising a sensor which senses when said first intake port is drawing in air instead of water, and electrically communicates such information to said controller which closes said first intake port and opens said second intake port.

Embodiment 13. The pool cleaner according to Embodiment 1 where said housing further comprises an interior chamber in which is situated said pump and where said first and second intake ports and said discharge port are in fluid communication with said interior chamber, with said first intake port configured to suction in pool water when said first intake port is open and said pool cleaner is in said first operation mode, and configured to suction in air when said first intake port is above water level which results in a buoyancy change of said housing causing said housing to tip into said inverted orientation.

Embodiment 14. The pool cleaner according to Embodiment 1 where said housing is a cylindrical tube and said rotationally-mounted supports comprise a set of wheels mounted to opposite ends of an axle extending axially through said housing.

Embodiment 15. The pool cleaner according to Embodiment 14 where said wheels have projections spaced circumferentially around the outer periphery thereof and extending in the axial direction, these projections being paddles that propel said housing when said housing is in said inverted orientation at water level and the wheels are turning.

Embodiment 16. The pool cleaner according to Embodiment 1 and where said housing has forward and rearward portions, and said rotationally mounted supports comprise a set of wheels mounted in each of said forward and rearward portions and.

Embodiment 17. The pool cleaner according to Embodiment 1 where said housing has forwarded and rearward parts, and said rotationally mounted supports comprise a set of axially spaced apart wheels mounted to an axle extending through one of said forward and rearward parts of said housing, and at least one additional wheel mounted at the other of said forward and rearward portions of said housing.

Embodiment 18. The pool cleaner according to Embodiment 17 where said additional wheel is tunable as directed by said controller to steer said pool cleaner.

Embodiment 19. The pool cleaner according to Embodiment 1 where said pool cleaner steerable by said controller which can directs selected rotationally mounted supports to rotate.

Embodiment 20. The pool cleaner according to Embodiment 1 where said rotationally mounted supports comprise a set of wheels that are mounted rotationally about a central axis that extends through said housing and are coupled to said electric motor, and said inverter further comprises a ring gear freely rotatably mounted about said central axis and having a predetermined weight fixed to said ring gear at a location near the outer periphery thereof, said inverter further comprising a second electric motor powered by said electrical power source and coupled to a pinion gear rotationally mounted to said housing and engaging said gear wheel, wherein said housing orientation is changeable from (a) the housing lower surface facing downward, (b) to the housing lower surface facing horizontally for wall climbing mode, (c) to facing upward in its inverted orientation, when said controller directs said pinion gear (i) to rotate and climb up said ring gear until said housing coupled to said pinion gear has tipped ninety degrees, and subsequently (ii) to further rotate said pinion gear until said housing has tipped another ninety degrees to its inverted orientation for skimming at water level.

Embodiment 21. The pool cleaner according to Embodiment 1 where said inverter comprises a gyroscope pivotally mounted to said housing and a stepper motor mounted to said housing powered by said electrical power source, and configured to later said gyroscope's axis of rotation whereby such that said gyroscope induces said housing to alter its orientation accordingly as directed by said micro-controller These objects and other advantages of the invention will be further understood and appreciated by those skilled in the art by reference to the following written specification, claims and the appended drawings.

BRIEF DESCRIPTION OF THE DRAWINGS

FIG. 16 is a first pictorial view showing the cleaning device orientated upright and being driven by its wheels while cleaning a bottom surface of the pool such that water enters a bottom intake port, flows through an internal filter assembly and is discharged through to a top discharge port;

FIG. 17 is a second pictorial view showing the cleaning device rotated approximately ninety degrees to clean a vertical sidewall of the pool such that the filtered water is discharged in a substantially horizontal direction;

FIG. 18 is a third pictorial view showing the cleaning device positioned at the water surface;

FIG. 19 is another pictorial view showing the cleaning device rotated a second ninety degrees to its inverted orientation such that the lateral intakes are orientated to permit pool water to enter the cleaning device for filtering and discharge through its discharge port which is orientated at the bottom of the pool cleaner housing. In this inverted orientation optional solar panels positioned on the bottom surface of the cleaning device are facing upwardly to receive any available sunlight;

FIG. 20 is yet another pictorial view showing the cleaning device having moved along the top surface of the water and floating with its solar panels exposed to sunlight from above and now in battery charging mode;

FIG. 21 is a still another pictorial view showing the cleaning device with a power cable coupled to an external electrical power outlet providing power to the cleaner for charging the optional internal batteries;

FIG. 23 is a schematic end elevation view in section of FIG. 22, showing the trackable weight at the bottom of the housing for orienting the pool cleaner in upright orientation at the floor surface of the pool.

FIG. 24 is a schematic end elevation view in section of FIG. 22 showing the trackable weight at the side of the housing for orienting the pool cleaner ninety degrees counterclockwise when cleaning a vertical sidewall of the pool;

FIG. 25 is a schematic and elevation view in section in section of FIG. 22 showing the trackable weight moved for orienting the cleaning device another ninety degrees counterclockwise in an inverted orientation at the waterline;

FIG. 30A' is an enlarged detail from FIG. 30A. FIG. 30A" a side elevation view of FIG. 30A'

Figure 1:
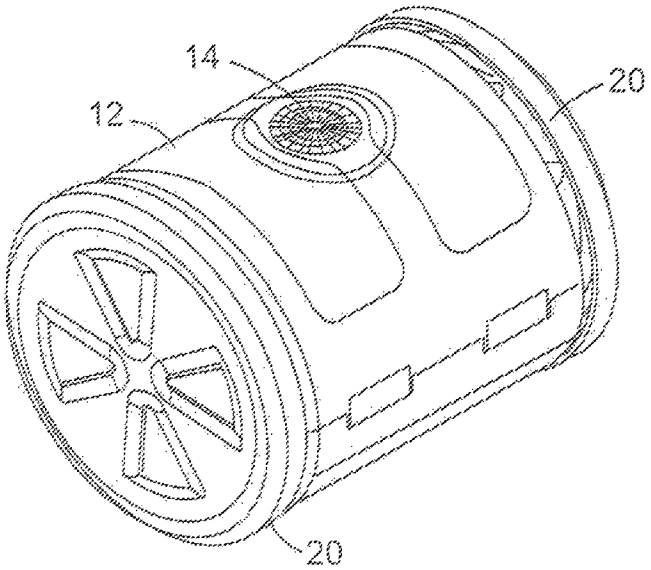
FIG. 1 is a top, front left side perspective view of a self-propelled robotic pool cleaning device of the present invention.
Figure 3:
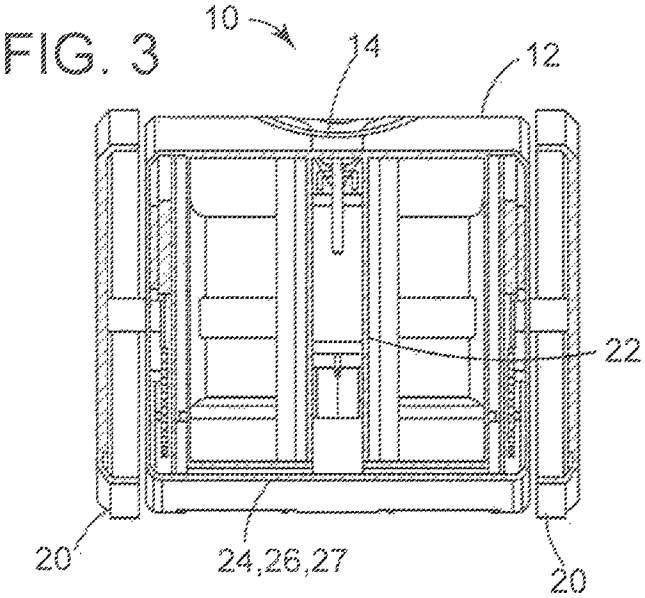
FIG. 3 is a cross-sectional view taken along line 3-3 of FIG. 2.

To further facilitate an understanding of the invention, the same reference numerals have been used when appropriate to designate the same or similar elements which are common to the figures. Unless otherwise indicated, the structures shown in the figures are not drawn to scale and are shown for illustrative purposes only.

DETAILED DESCRIPTION OF THE PREFERRED EMBODIMENTS

Figure 17:
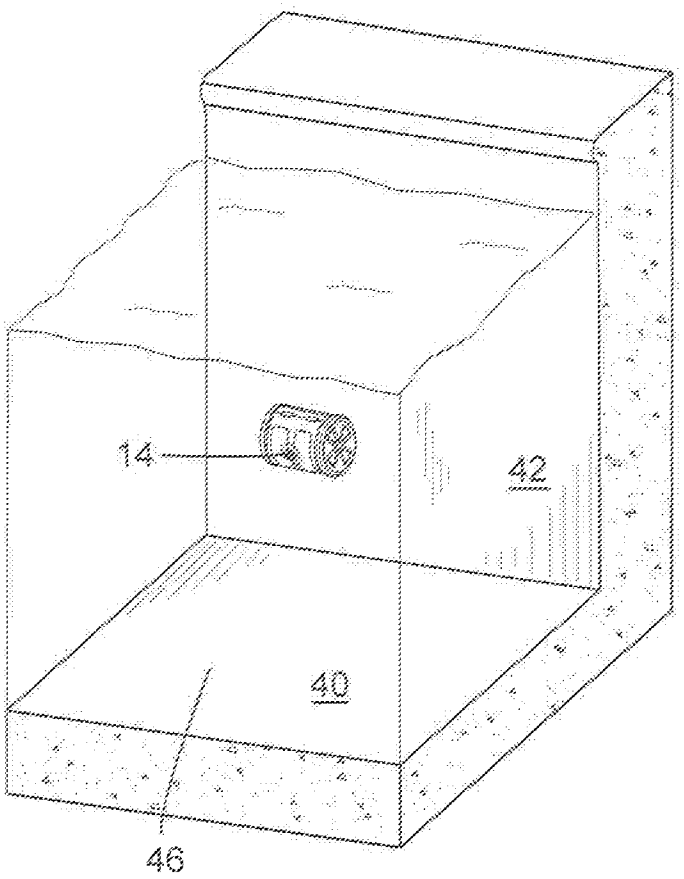
FIGS. 16-21 comprise a set of pictorial views showing a sequence of movements by the cleaning device of FIG. 1 as it traverses along a path from the bottom of the pool, up a sidewall and at the pool water surface, where.
Figure 18:
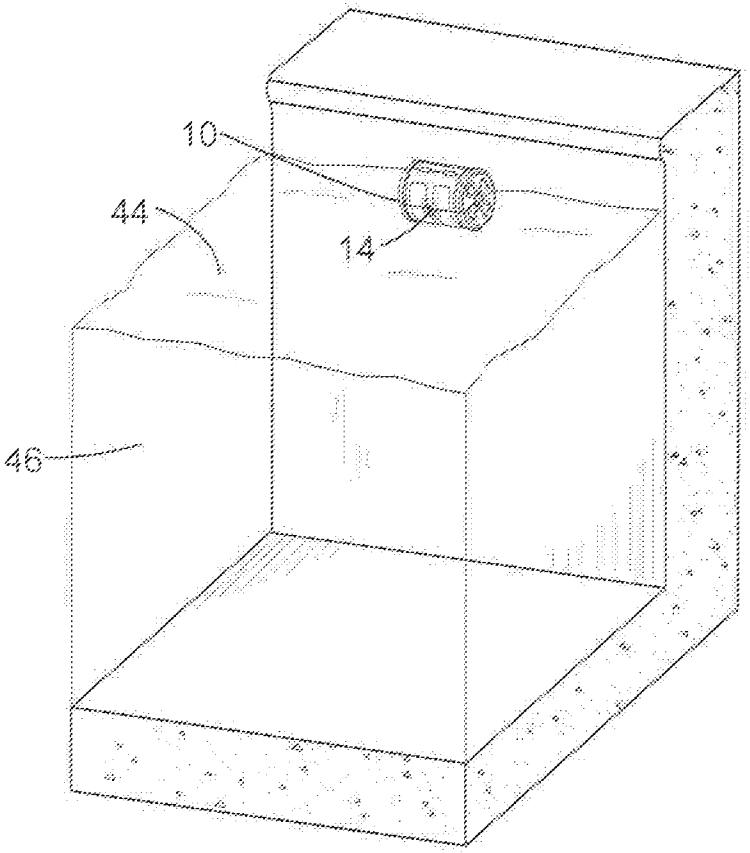

For convenience and better understanding of the invention the new cleaning device described herein is considered in its "upright" position as illustratively depicted in in FIGS. 1-11, and rotated ninety degrees as illustratively depicted in FIGS. 17 and 18, and rotated 180 degrees to an inverted position as illustratively depicted in FIGS. 12-15. A preferred embodiment of the cleaning device 10 as seen in the figures includes a generally cylindrical housing 12 having a water jet discharge port 14 situated in the top surface of the housing (see FIGS. 1-4), first intake ports 18 (at the bottom in FIGS. 4, 8, 9, and 11) and second intake ports 16 (lateral at the side in FIGS. 4 and 6). This embodiment also includes drive wheels 20 at opposite ends of the housing (FIGS. 1-7). Each lateral intake port 16 can be closed with a port door 17, and the bottom intake port can be closed with port door 19. Opening and closing of the port doors will depend on the mode of operation as further described below.

Figure 5:
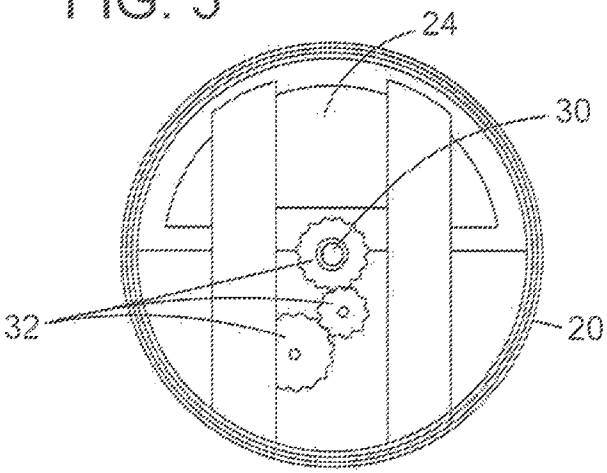
FIG. 5 is a cross-sectional view taken along line 5-5 of FIG. 4, showing an internal battery and a gear train for driving the wheels to move the cleaning device of FIG. 1.
Figure 7:
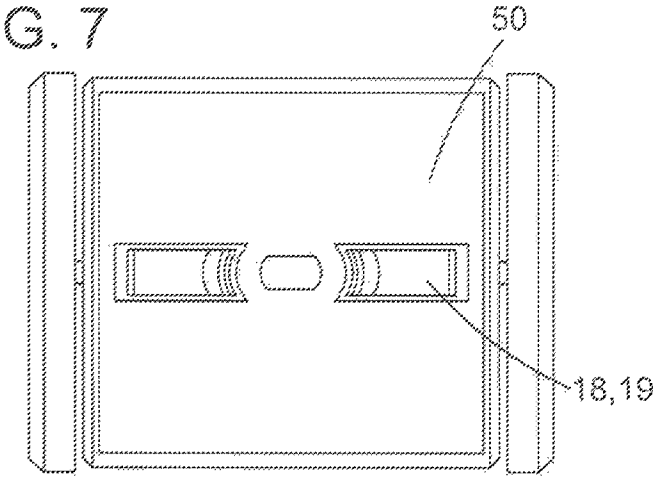
FIG. 7 is a bottom plan view of the cleaning device of FIG. 1 illustrating a first pair of intake ports for cleaning at a surface of the pool.
Figure 4:
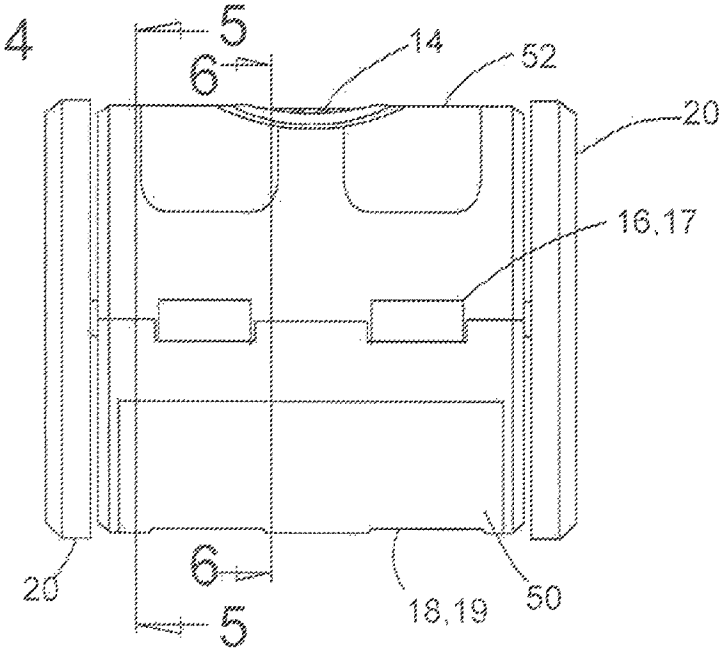
FIG. 4 is a front elevational view of the cleaning device of FIG. 1.

As seen in FIGS. 3-6, within housing 12 is a chamber 22 for containing an optional battery 24, motor 26 mounted in motor cradle 27 and motor stabilizer 28. The motor 26 serves to rotate the water pump 34, as well as rotate the drive wheels 20. Referring to FIG. 5, a sectional view through a vertical plane indicated by line 5-5 in FIG. 4 shows a gear train 32 connected to the drive shaft of the motor 26 which collectively drive the wheels' center axle 30 (FIGS. 5 and 7) and its opposing wheels 20. Although the cleaner is discussed being powered by an internal battery, it will be appreciated that electrical power can be alternatively provided to the cleaner by an external power source via a power cable connected to the power source and the cleaner.

Figure 6:
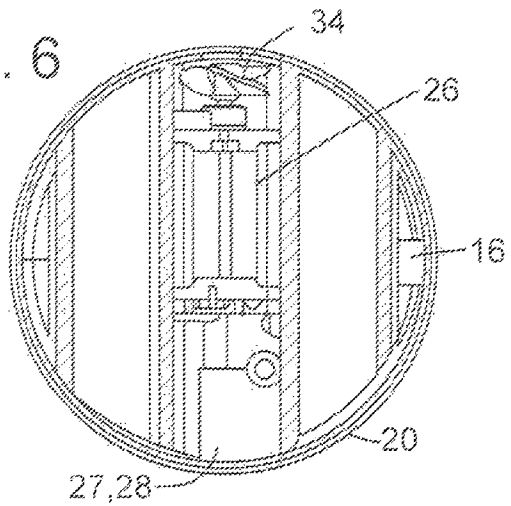
FIG. 6 is a cross-sectional view taken along line 6-6 of FIG. 4, showing an internal water pump.
Figure 11:
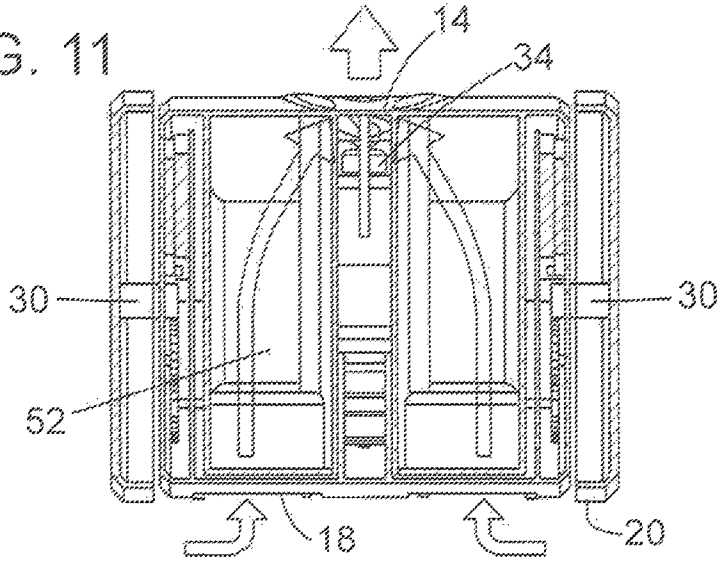
FIG. 11 is a cross-sectional view taken along line 11-11 of FIG. 10 illustrating the water flow and filtering through the cleaning device during the pool surface cleaning mode of operation.
Figure 8:
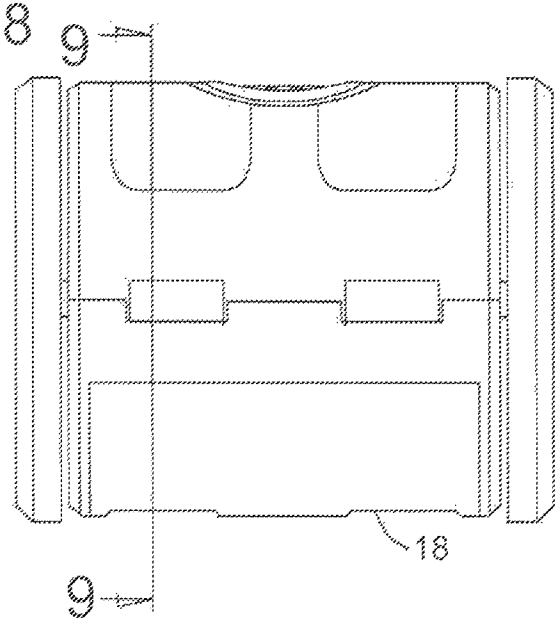
FIG. 8 is the front elevational view of FIG. 4 illustrating a second pair of intake ports for skimming operations at the surface of the pool water.
Figure 10:
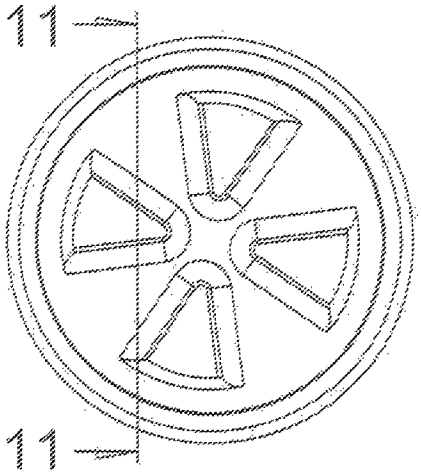
FIG. 10 is a right, side elevational view of the cleaning device of FIG. 1 in its upright state, the left side being a mirror image thereof.

Referring to FIGS. 6 and 11, the motor 26 has an output drive shaft extending from a first end in a direction vertically upward (in this upright orientation of the pool cleaner) for rotating an impeller 34 having a plurality of blades which serves as the water pump to generate the flow of water through the cleaner. The vertically oriented motor 26 preferably includes a worm drive provided at the opposite second end of the motor 26 which drives the gear train 32 to rotate the perpendicularly positioned central axle 30, which in turn rotates wheels 20. Although a single motor 26 is illustratively shown to provide power to the impeller 34 and the wheels 20, it will be understood that separate electric motors can be used to drive the impeller and the wheels.

Figure 26:
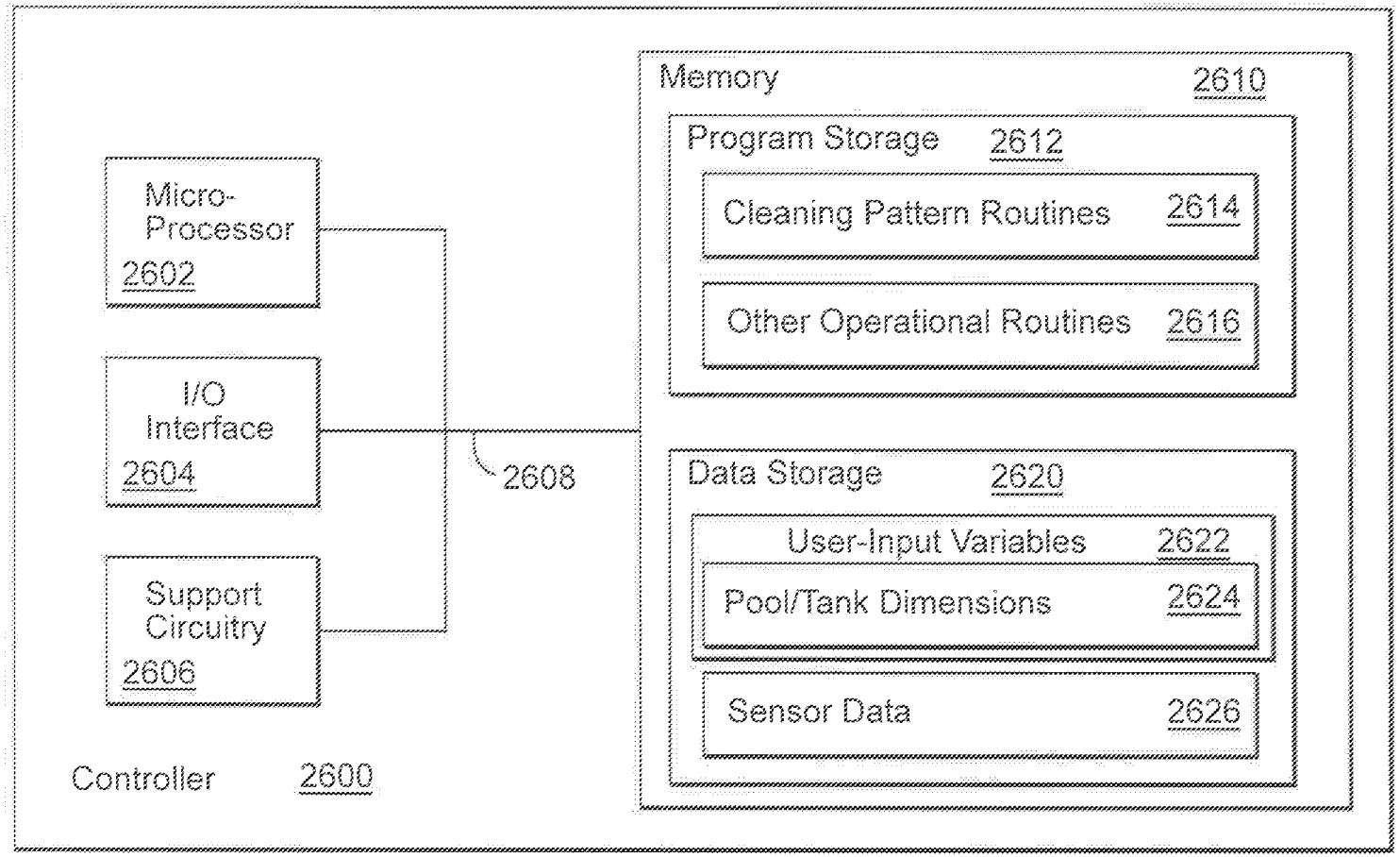
FIG. 26 is a high-level block diagram of a controller suitable for use with the cleaning device of FIG. 1.

Referring now to FIG. 26, a high-level block diagram of a controller 2600 suitable for use in the cleaning device 10 of FIG. 1 is illustratively shown. The controller is preferably a micro-controller which is installed onboard the cleaning device 10. Alternatively, the controller 2600 can be installed in an external power supply from which control signals are sent over a power cable electrically coupled between the external power supply and the cleaning device 10. The block diagram illustrates high-level functional aspects of the micro-controller. Specifically, the microcontroller 2600 includes a micro-processor 2602, one or more input/output (I/O interfaces 2604, support circuitry 2606, as well as memory 2610 for storing various operational and cleaning programs 2612. Communications between the various microcontroller components are facilitated via one or more bus lines 2608.

The processor 2602 cooperates with conventional support circuitry 2606, such as power supplies, clock circuits, cache memory and the like, as well as circuits that assist in executing the software routines stored in the memory 2610. The memory 2610 is shown as functionally identifying program storage 2612 and data storage 2620. The program storage 2612 can include one or more cleaning pattern routines 2614 and other operational routines 2616 (e.g., battery charging routines). The cleaning pattern routines 2614 can be preinstalled by the manufacturer with different cleaning patterns and/or durations, and thereafter selectable by the end-user. The data storage 2620 can include user-input data 2622, such as dimensions/configuration of the pool 2624 for which the cleaning device 10 will be used, as well as sensor data 2626, and the like. It is contemplated that some of the process steps discussed herein as software processes can be implemented within hardware, for example, as circuitry that cooperates with the processor 2602 to perform various steps. In one embodiment, the micro-processor 2602 executes a cleaning pattern routine 2614 using the pool dimension/configuration data 2624 previously inputted into the memory 2622 by a field technician or end-user.

The controller 2600 also contains input/output (I/O) circuitry 2604 that forms an interface between the various functional elements communicating with the controller 2600. For example, in the embodiment of FIG. 1, the microcontroller 2600 can send instructions to a switch in communication with the pump motor 26 to reverse polarity and thereby change the rotational direction of the wheels at predetermined times in accordance with the cleaning pattern routines 2614. As well, the microcontroller 2600 can receive a low-battery indication from a sensor which monitors the voltage and/or current of the battery and then take the necessary steps to recharge the battery during a recharging mode of operation as discussed in further detail below.

Figure 2:
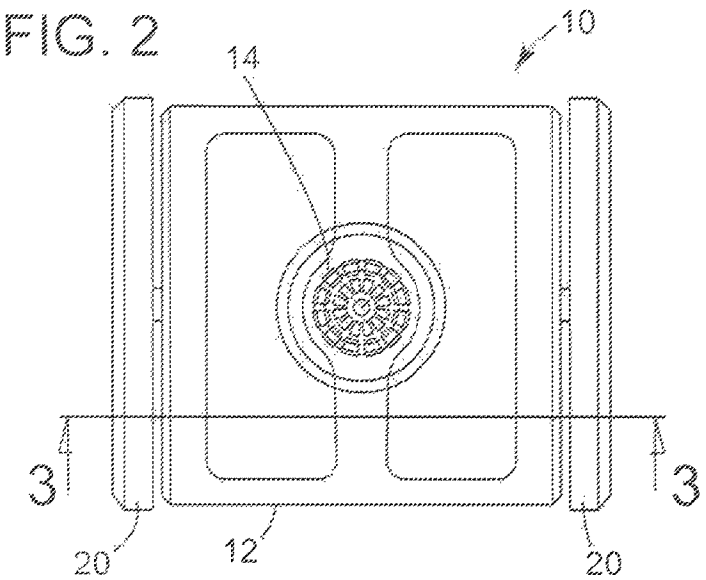
FIG. 2 is a top plan view of the cleaning device of FIG. 1.

Although the controller 2600 of FIG. 2 is depicted as a microcontroller or a general-purpose computer that is programmed to perform various defined and/or control functions for specific purposes in accordance with the present invention, the invention can be implemented in hardware such as, for example, an application specific integrated circuit (ASIC). As such, it is intended that the processes described herein be broadly interpreted as being equivalently performed by software, hardware, or a combination thereof.

Additional features of the pool cleaner can include one or more circuits/sensors that send electrical signals to the controller which subsequently directs reactions exemplified by those listed below:

a. to sense an approaching or a presently engaged wall, and in response reverse the rotational direction of the pump 34 to reverse the direction of movement of the cleaner, or initiate a steering routine e.g., controlling power to the drive wheels by interrupting power to one of the drive wheels, or initiate a wall-climbing mode of operation, b. to sense cleaner's orientation as upright on a bottom surface or rotated ninety degrees as it climbs a sidewall of the pool, and in response: to activate a trackable weight or movable buoyancy element for inverting cleaner body, c. to sense air intake into the internal chamber while the cleaner climbs a sidewall and its air intake when the cleaner rises above water line, and in response: activate a trackable weight or movable buoyant element to further pivot the cleaner to its inverted orientation, e.g., during a skimming mode or a battery recharging mode of operation, d. to sense battery charge when the cleaner is (1) submerged (at pool floor and in wall climbing modes), (2) while inverted and floating and receiving sunlight recharge, and/or (3) skimming and receiving recharge if sunlight is available. The response for weak battery charge is to reduce functions, i.e. reduce speed and travel, and particularly while inverted to slow paddle rotation or to stop paddles and merely float until solar recharging is begun/completed.

e. to sense sunlight intensity when inverted, and in response to low sunlight, reduce cleaner functions so that batteries can be expediently recharged with minimal power losses from other operations, f. to sense filter condition, as (1) normal or "okay", (2) partially clogged or (3) fully clogged, and in response: terminate travel and filtering while submerged or terminate skimming while on the surface, and/or g. to sense passage of time, and in response: change or terminate programmed travel pattern/path.

Modes of Operation Summarized in the Storyboard Pictorials in FIGS. 16-21

Figure 16:
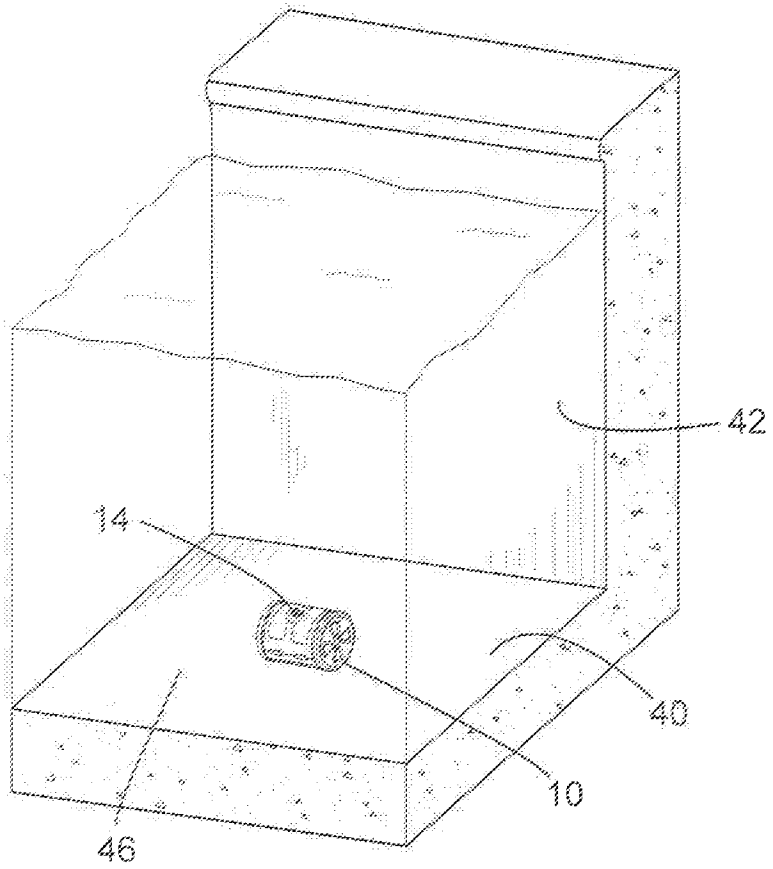

FIG. 16 shows the cleaning device 10 in the above-described upright or first orientation with its water discharge port 14 at the top and its intake port 16 at the bottom. The cleaning device 10 filters water as it moves along the bottom surface of the pool 40. This cleaning device 10 maintains balance and upright orientation while submerged by the downward force produced from the upwardly directed water jet, as well as the suction forces below the intake port(s) which are generated by the pump 34 as it cleans along the bottom of the pool. Additionally, there can be a strategically placed internal weight (or strategically altered buoyancy) component creating an changed center of gravity.

FIG. 17 shows cleaning device 10 having rotated ninety degrees so that its bottom surface faces the vertical wall 42 of the pool as the cleaning device 10 proceeds to clean and climb the wall. In this orientation the intake port 16 faces vertical wall 42 with a suction force directed toward the wall, and the discharge port 14 is directed in the opposite and substantially horizontal direction. The cleaning device 10 climbs the wall due to rotation of its driven rotationally mounted supports 20, e.g., wheels or tracks with friction surfaces which maintain traction on the walls by the force of the water jet exhaust directed opposite the wall. The cleaning device 10 preferably cleans the bottom and sidewalls of the pool in accordance with one or more pre-programmed cleaning routines 2614 (see High Level Block Diagram, FIG. 26) which are stored in the controller's internal memory 2610 and executed by a microcontroller/processor, timers, counters, and the like in a manner well-known in the art, and as discussed below in further detail with reference to FIG. 26. The cleaning device 10 can travel back and forth along the bottom of the pool, as well as up and down its vertical side walls in accordance with the cleaning routines 2614 or a predetermined time or predetermined number of laps to ensure adequate cleaning of the submerged surfaces of the pool. Alternatively, the cleaning device 10 can move pursuant to a random direction program to clean along surfaces of the pool.

FIG. 18 shows the cleaning device 10 having climbed toward and reaching the top surface 44 of pool water 46 at the end of its submerged wall-surface cleaning cycle. The cleaning device 10 has a prolonged wall climb to assure that it reaches the waterline (top surface of the water) and then sucks in air through the bottom intake port(s). With air in the internal chamber that houses the pump motor 26 and impeller 34 of cleaning device 10, the controller is programmed to turn off the motor 26, and the unit remains afloat due to the air retained in the chamber 22. In one embodiment where all cleaning operations have finished (or are discontinued by the user), the cleaning device continues to float at the surface for retrieval by a user. Alternately, the cleaning device 10 can go into a skimmer mode of operation and/or a battery recharging mode of operation, as described below in further detail.

Figure 13:
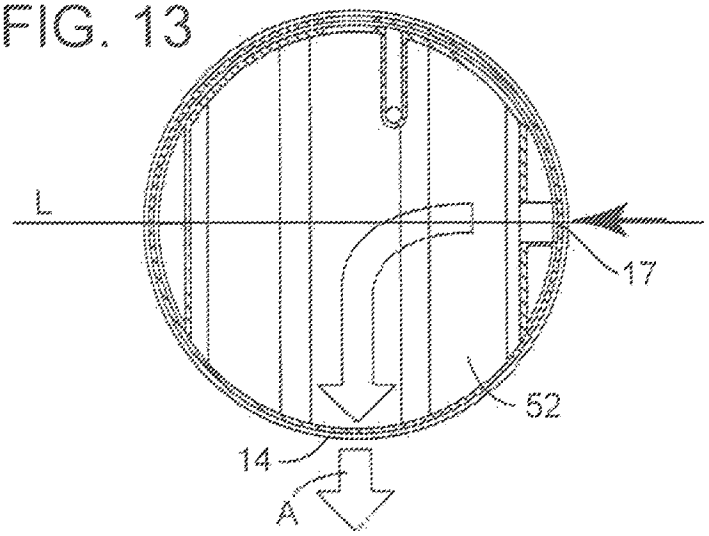
FIG. 13 is a cross-sectional view taken along line 13-13 of the inverted cleaning device of FIG. 12 illustrating water flow through the cleaning device during a water skimming mode of operation to clean the surface water of the pool.
Figure 19:
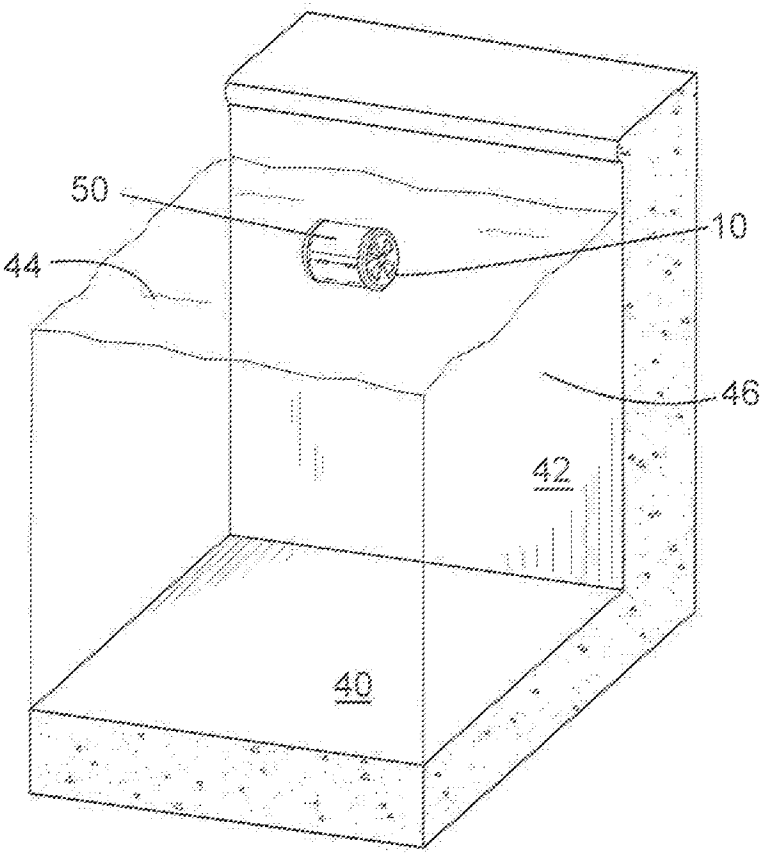

FIG. 19 shows the cleaning device 10 having rotated another ninety degrees so that it is inverted or upside down relative to its starting orientation on the bottom surface of the pool, and with its discharge port 14 facing downward and with the solar panels 50 facing upwardly to receive any sunlight that is available. This inverted orientation can be the result of a variety of structural and functional arrangements. In one embodiment, when cleaning device 10 rises to the water line and air instead of water is drawn into the internal chamber via the first intake ports 18, the device's buoyancy and center of gravity are altered such that the device rotates one-hundred and eighty degrees about its longitudinal axis "L" (see FIGS. 12 and 15) onto its back where its solar panels 50 on the bottom are now at the top, facing upward. Referring to FIG. 13, the cleaning device 10 is shown in its inverted floating position such that its midline and second (lateral) intakes 16 are at the top water level with appropriate buoyancy so that its skimmer doors can open.

Figure 15:
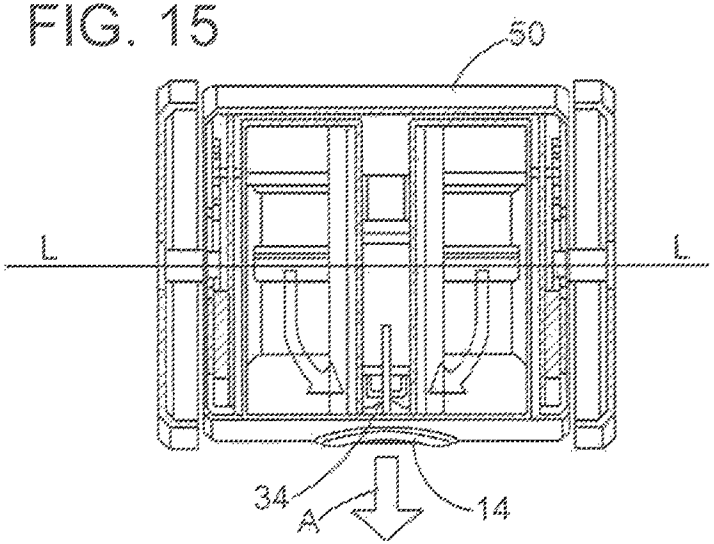
FIG. 15 is a cross-sectional view of the cleaning device in its inverted state taken along line 15-15 of FIG. 14 and showing the flow of water therethrough during its skimming mode of operation.

As shown in FIGS. 13 and 15, the arrow A indicates the passage of water through lateral intakes 16, thence through filter 52, and finally filtered water being discharged via outlet 14. In this orientation, the cleaning device is inverted with its lateral intakes 16 at or below water level and an outlet 14 below the water level and in contrast to the submerged modes. As the pump motor 26 is turned on, a low pressure area is formed in the chamber 22 proximate the lateral intakes 16 such that water will be drawn through the lateral intakes 16 and will flow through filter(s) 52. Pool water is forced through the filter media, retaining debris in the filter medium (e.g., cartridges), and filtered water is returned to the pool via the discharge port 14, which is facing downward on the submerged side of the cleaning device 10.

Figure 12:
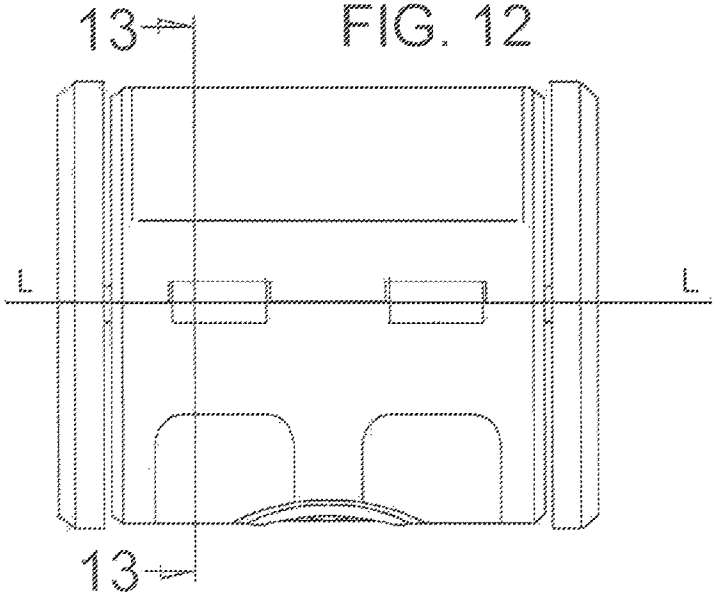
FIG. 12 is a front elevation view of the cleaning device of FIG. 1 in an inverted state during its water skimming mode of operation.
Figure 14:
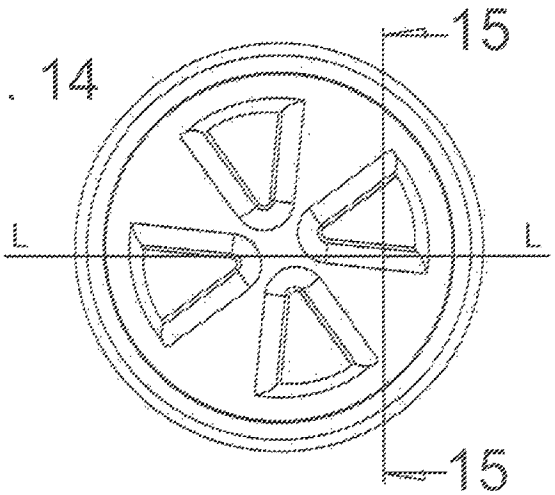
FIG. 14 is a right side elevational view of the cleaning device FIG. 12 in its inverted state, the left side being of mirror image thereof.
Figure 20:
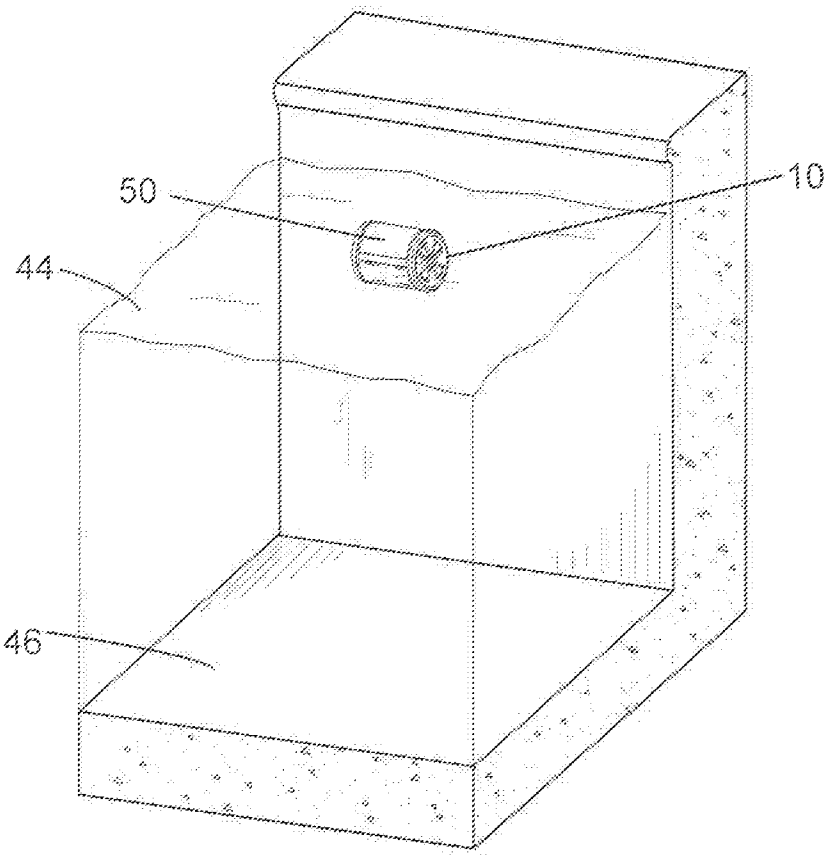
Figure 22:
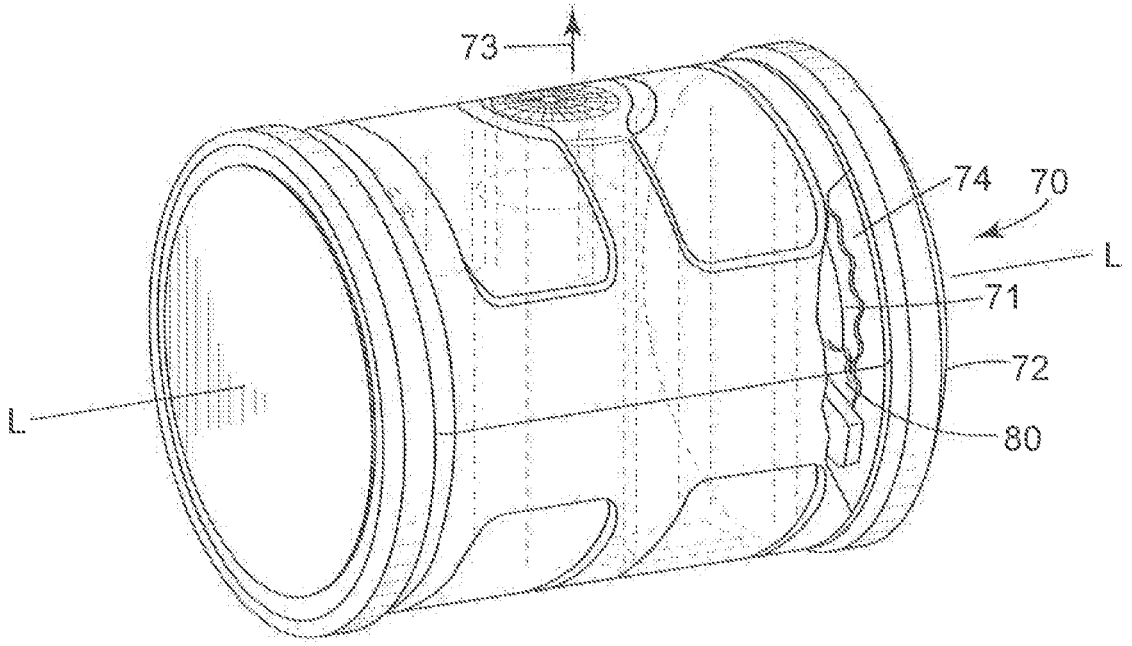
FIG. 22 is a top front perspective view of the cleaning device configured to alter its orientation from vertical to horizontal and then to inverted.

FIGS. 13-15 and 19 depict the cleaning device in skimming mode along the pool water surface. In contrast to the submerged mode, the pump motor 26 is now directed to operate on a slower skimmer cycle which filters the water and also slowly rotates the wheels or tracks that have outwardly and/or inwardly extending protrusions which function as paddles allowing the cleaning device 10 to move across the water surface in the skimming mode or operation, to collect debris from the surface of the water. The cleaning device 10 can be directed by the processor/controller's 2600 programming to follow a predetermined path on the surface of the water while in the skimming mode. In FIGS. 18-20, the cleaning device 10 is shown schematically and pictorially at the water surface; however, in these skimmer cycle or skimmer modes the cleaning device 10 is situated with its midline at water level as best shown in FIGS. 12-14.

Charging Cycle

FIG. 20 shows cleaning device 10 with the solar panel(s) 50 facing upwardly during the charging mode of operation. Rotation of wheels 20 with paddle-like protrusions 106 (see FIG. 28) will slowly propel the skimmer along the water surface. If the battery is running low on charge during this skimming cycle, a battery charging program overrides and stops the skimming cycle program until the battery obtains enough charge to finish the cleaning cycle without interruption. Suitable sensors for determining the charged condition of the battery are operatively connected to the processor/controller.

Cable Charging Option

Figure 21:
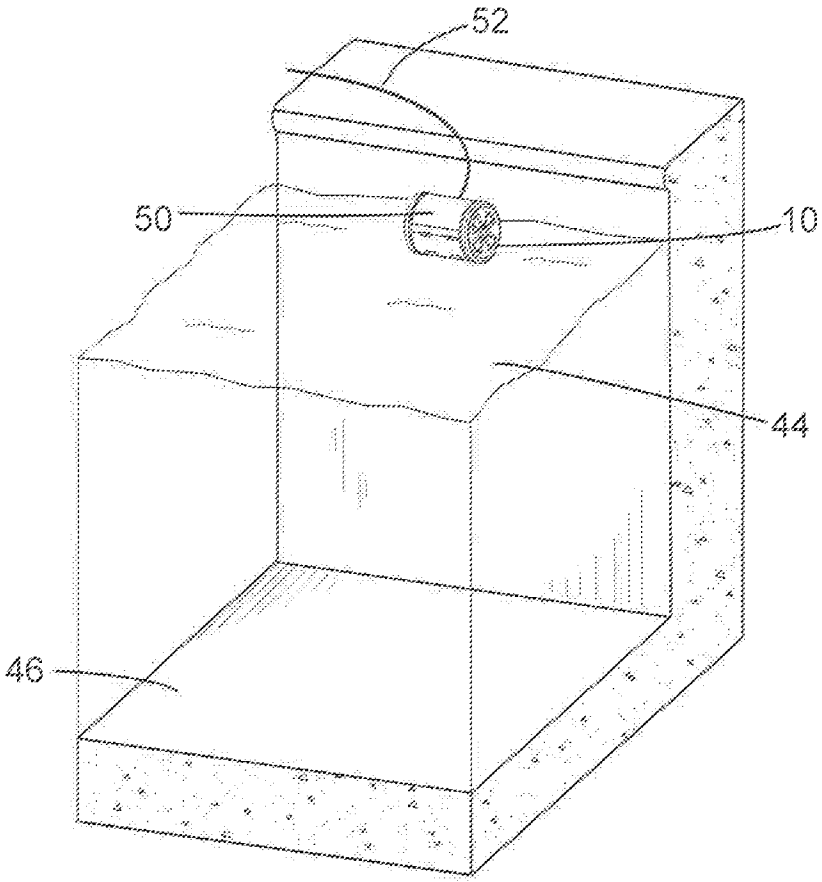

As an alternative to solar panel charging of the battery, FIG. 21 shows the cleaning device 10 temporarily connected to a power cable 52 from a remote power source for charging the internal batteries of the cleaning device 10.

Figure 9:
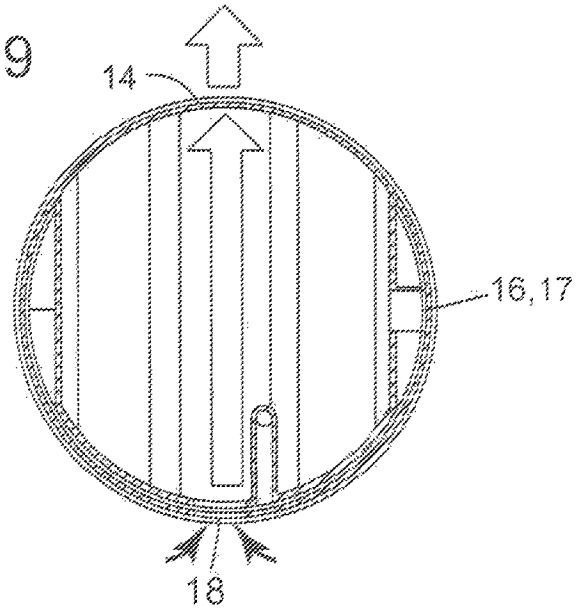
FIG. 9 is a cross-sectional view taken along line 9-9 of FIG. 8 illustrating water flow through the cleaning device during a pool surface cleaning mode of operation to clean the immersed surfaces of a pool.

Water Flow Paths During Pool Surface Cleaning and Water Skimming Modes of Operation FIGS. 9 and 11 show the cleaning device 10 in its upright position during its pool surface cleaning operation while traversing the bottom surface of a pool (also seen in FIG. 16). In this orientation, the bottom intake ports 18 is open and the rotating impeller blades 34 create a low pressure zone in the chamber 22 proximate the bottom intake port 18 to draw pool water through the bottom intake port 18 and thence through filters 52 within housing 12, and finally discharging the filtered water out of (top surface) the discharge port 14. In this pool bottom surface cleaning mode and orientation, discharged water is pumped upward through discharge port 14 in the form of a water jet which creates an opposite reaction force thereby pushing the housing downward toward the surface beneath it. The downward force urges the drive wheels 20 to be in firm and frictional contact with the pool floor surface where they can more efficiently drive the cleaning device 10 transversely across the bottom surface. During this pool floor-surface cleaning mode and orientation of the cleaning device 10, the lateral intake port doors 17 are closed so that all water flow moves from the bottom intake port 18 of the cleaning device 10, upward through filters and out the water jet discharge port 14.

Referring now to FIG. 17, the cleaning device 10 is moving upward on a vertical wall of the pool. In this orientation, the lower portion of the cleaning device 10 and its intake port 18 are facing the vertical wall while the discharge port 14 is facing horizontally or substantially horizontal in the opposite direction away from the vertical wall. The dynamics of this climbing operation are generally similar to those described for the transverse motion along the bottom surface 24 of the pool, where the intake port 18 faces the bottom surface and the discharge port 14 faces in the opposite direction, whereby the discharge port tends to urge the cleaning device 10 toward the surface being traversed. With this urging of the cleaning device 10 against the vertical wall in FIGS. 17 and 18, the wheels or tracks 20 driven by motor 26 will have maximum friction with the wall 42, whereby the cleaning device 10 will climb upward on the wall until it reaches the top of the water surface 44, as seen in the climbing pictorials of FIGS. 17 and 18.

After the cleaning device 10 arrives at the top water surface 44 as seen in FIG. 18, the cleaning device 10 will rotate another ninety degrees until the discharge port 14 is facing downward (FIGS. 19 and 20), but its discharge port door (not shown) is closed, and solar panels 50 are now situated at the top exposed surface of the cleaning device 10. In this inverted mode of operation of the cleaning device 10 as seen in FIGS. 13, 15, 20 and 21, the water jet impeller or pump blades 34 are now situated at the bottom (see FIG. 15), and the lateral intake ports 16 are opened, as directed by the controller. The water jet pump 34 draws water into lateral intake ports 16, thence through filters 52 and finally out through discharge port 14. This water flow path allows the cleaning device 10 to continue filtering water while its solar panels 50 face upward for recharging battery 24. Nominally the lateral intake ports are at mid-level of the housing, but while in skimming mode these intake ports need to be below water level so that the inflow will be preferably only pool water without air. Accordingly, the housing will be designed to have appropriate buoyancy when in inverted mode.

As noted above, the lateral inlet ports are closed when the cleaner is in its upright orientation, with the normal inward flow of water entering via the bottom inlet(s). The lateral inlets can be kept closed by spring-biased doors or other valves or can be gravity controlled. The lateral inlets can be opened from the pump suction created in the interior chamber once the bottom inlets are closed. Alternatively, the controller can provide control signals to the actuators of control valves which open and close the inlet doors. Because the discharge outlet port 14 is open during both upright and inverted orientations of the cleaner, it is not necessary to provide a valve or closure with respect to the discharge outlet port 14.

Alternate Embodiments for Changing Pool Cleaner Orientation

Various embodiments are disclosed herein where a pool cleaner's orientation can be altered from upright on the bottom of the pool, to horizontal for climbing a sidewall, to inverted at the water surface for skimming and/or charging operations. This will be described with the devices' components and operation.

Altering Cleaner Orientation Ninety Degrees by a Trackable Weight. FIGS. 22, 23, 23A, 23B, 24, and 25, show pool cleaner device 70 including its outer housing 71, inner frame mounted in the housing, outboard wheels 72, internal main electric motor and gear drive (not shown) coupling the main motor to wheels 72. Gear wheel 74 is coupled to said housing and is freewheeling. Gear teeth 76 around the periphery of gear wheel 74 face inwardly. Trackable weight 77 is fixed at the periphery of gear wheel 74. Stepper motor 78 (see FIGS. 23A, and 23B) is mounted to said inner frame or housing, and stepper pinion gear 80 driven by stepper motor 78 has gear teeth 82 engaged to teeth 76 of gear wheel 74.

Figure 23:
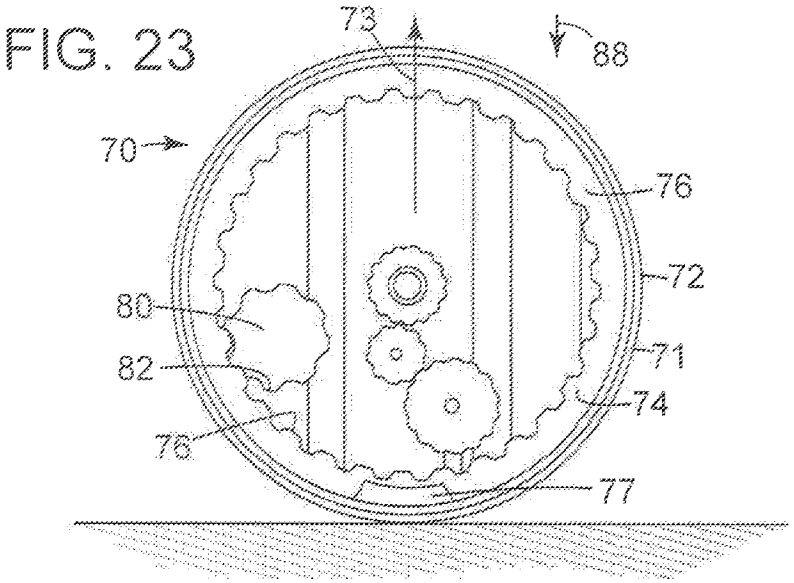

FIG. 23 shows the pool cleaning device 70 on the pool floor with gear wheel 74 situated with its trackable weight 77 at a 6 o'clock position and water ejection upward per arrow 73, as also seen previously in FIG. 9. This is the natural or normal position since trackable weight 77 always seeks the 6 o'clock lowest position due to gravity acting on said weight.

When stepper motor 78 is activated by a controller programmed impulse, the stepper motor rotates stepper pinion gear 80 which begins to climb up gear teeth 76 of gear wheel 74. Gear wheel 74 tends to remain in a non-rotated orientation because weight 77 seeks the lowest position at 6 o'clock.

Figure 24:
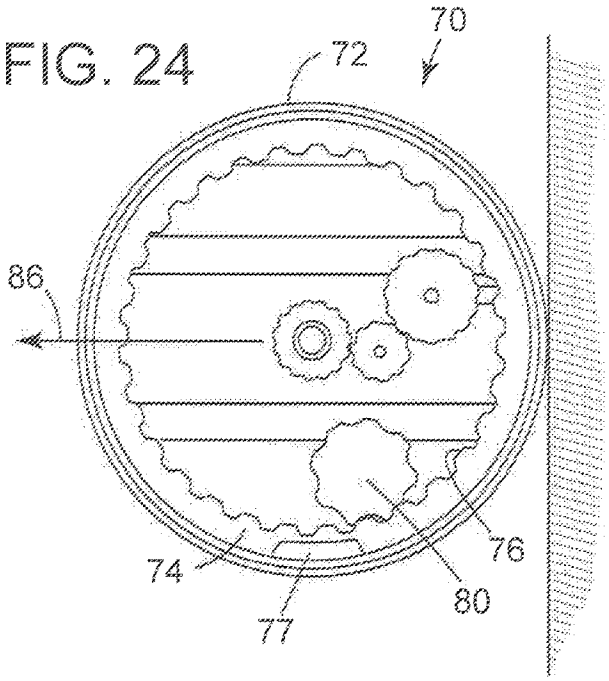
FIGS. 23, 24, and 25 show the sequence of stages of a pool cleaner of FIG. 22 altering orientation from vertical to horizontal to inverted, where.

Referring to FIGS. 22 and 11, 12 and 6, housing 71, inner frame, main motor 26 and pump 34 can function as an integrated system which can rotate about the device's central horizontal axis "L". Such rotation of the integrated system occurs relative to the non-rotation of gear wheel 74 with its heavy weight 77. The magnitude of this weight can be determined as enough to more than counter-balance the weight of the housing and its contents. Consequently, activation of stepper motor 78 rotates stepper pinion gear 80 which begins to climb around gear 74. Movement or translation of pinion gear 80 circumferentially about central axis L of the housing necessarily rotates the integrated system of housing and its contents (e.g., pump 26, impeller 34, inner frame, and the like), until stepper motor 78 stops rotating. By programmed control, the stepper motor may stop just before device 70 will begin its climb up the pool wall, as seen in FIG. 24. It is noted that the gear wheel 74 has maintained its orientation with weight 77 at the bottom 6 o'clock location, while housing 70 has rotated now with water ejection horizontally outward in the direction of arrow 86 from the vertical wall.

While this is a dynamic transition, it can be more easily understood if one understands that ring gear 74 with its weight 77 at the 6 o'clock position remains in that position, with the housing in upright orientation and pump discharge upward. Then pinion gear 80 climbs up to the 3 o'clock position moving the whole housing to which it is attached ninety degrees, so that now the pump discharge is directed to the left toward 9 o'clock and ring gear remains with weight 77 at 6 o'clock. Finally, assume that by now the wheels have propelled the housing to a wall. Since the housing has been rotated ninety degrees counter-clockwise from the housing's prior upright orientation on the floor of the pool, the wheels engage the wall start to climb up the wall. In this rotated position the pump discharge is horizontal to the left with suction toward the wall being climbed. Finally, in this simplified description, ring gear 74 still has weight 77 at the 6 o'clock position and housing has rotated counter-clockwise to wall climbing mode. A corresponding transition can occur when the cleaner housing reaches water level.

Figure 25:
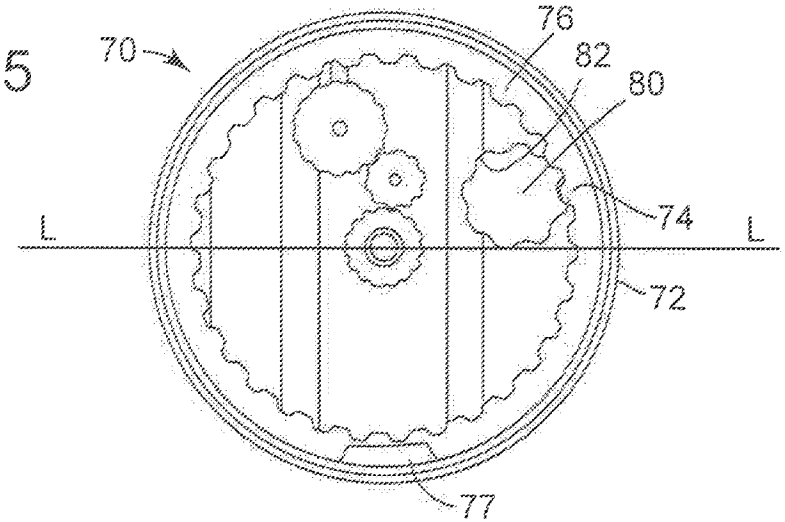
Figure 23A:
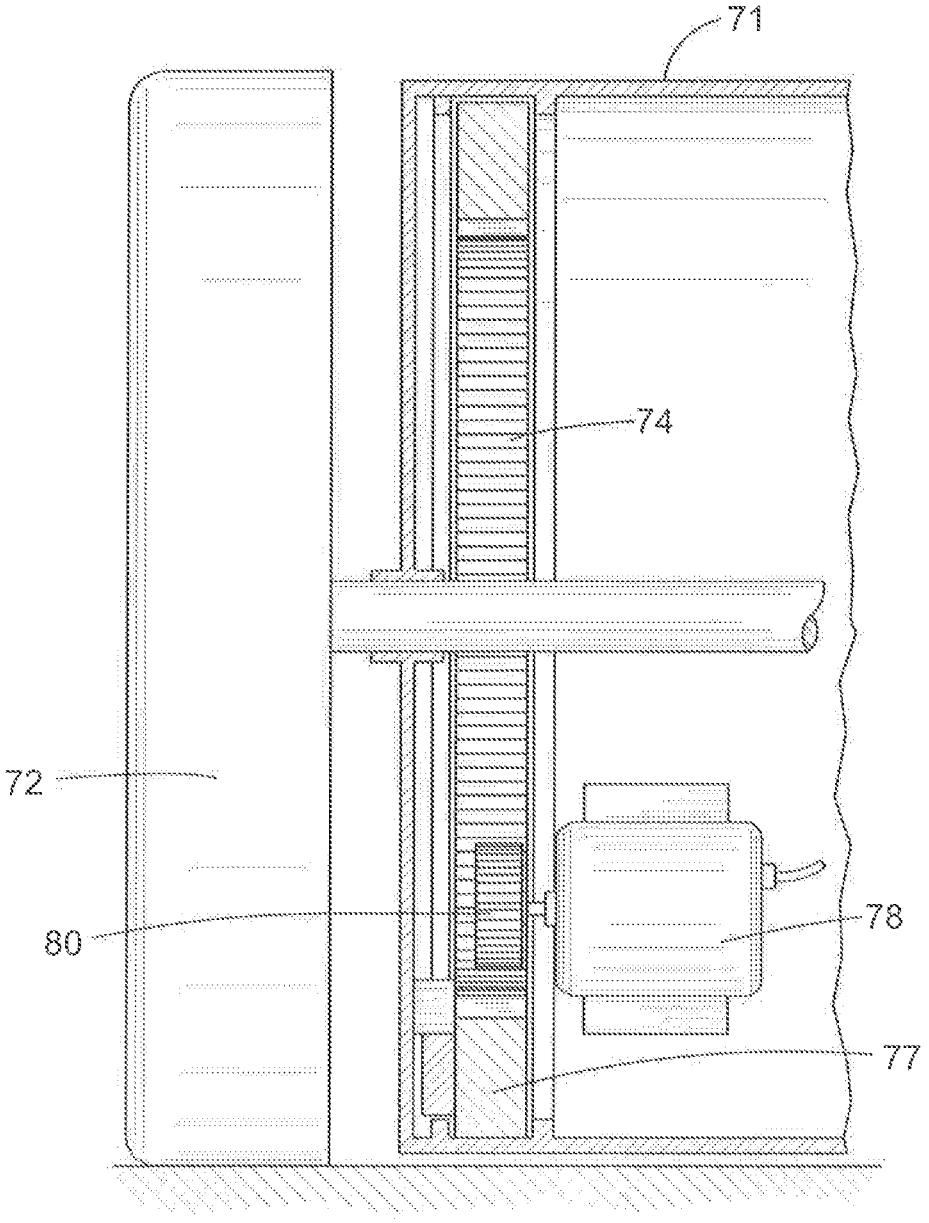
FIGS. 23A, 23B, and 23C are fragmentary sectional views showing the pinion gear interacting with the gear wheel.
Figure 23B:
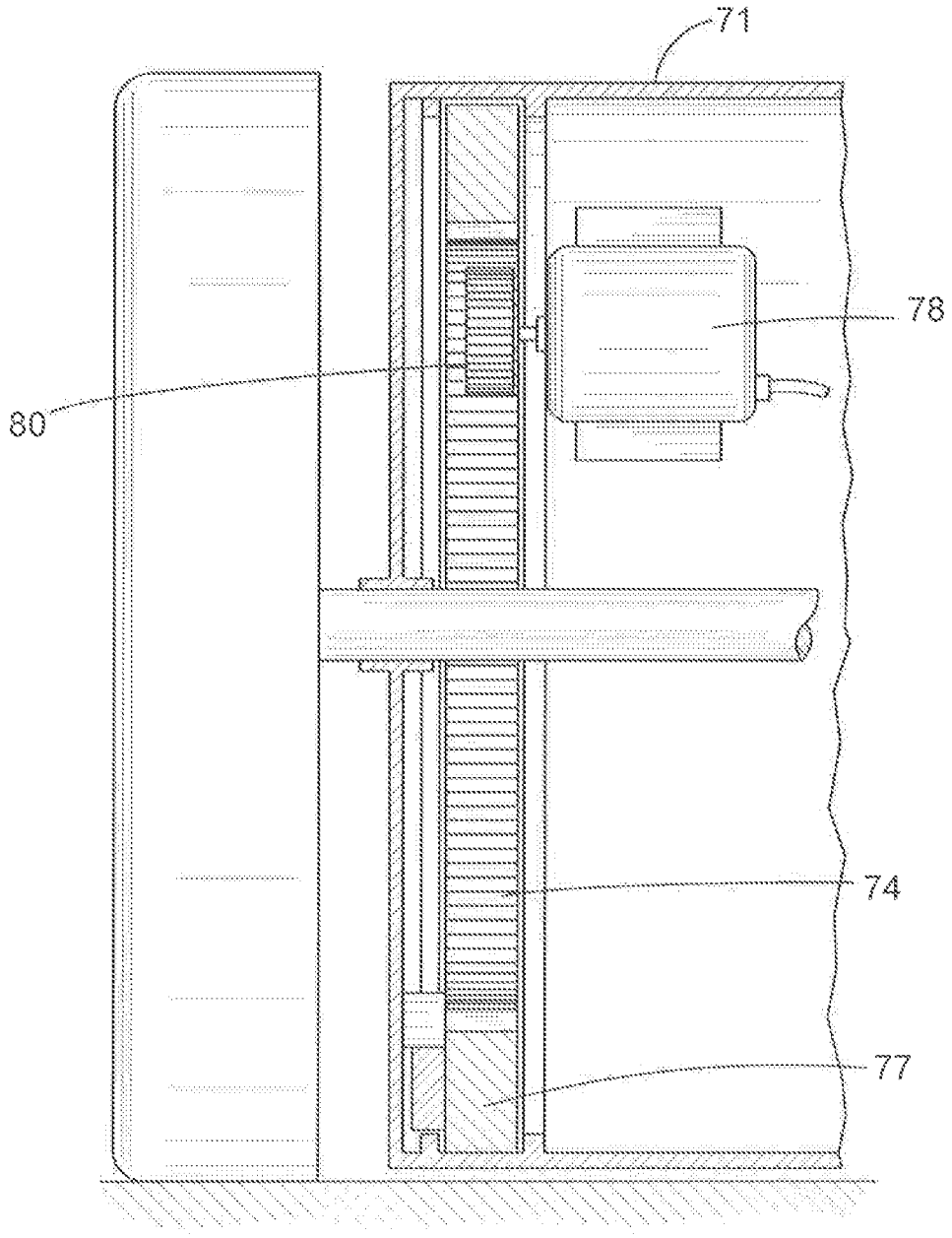
Figure 23C:
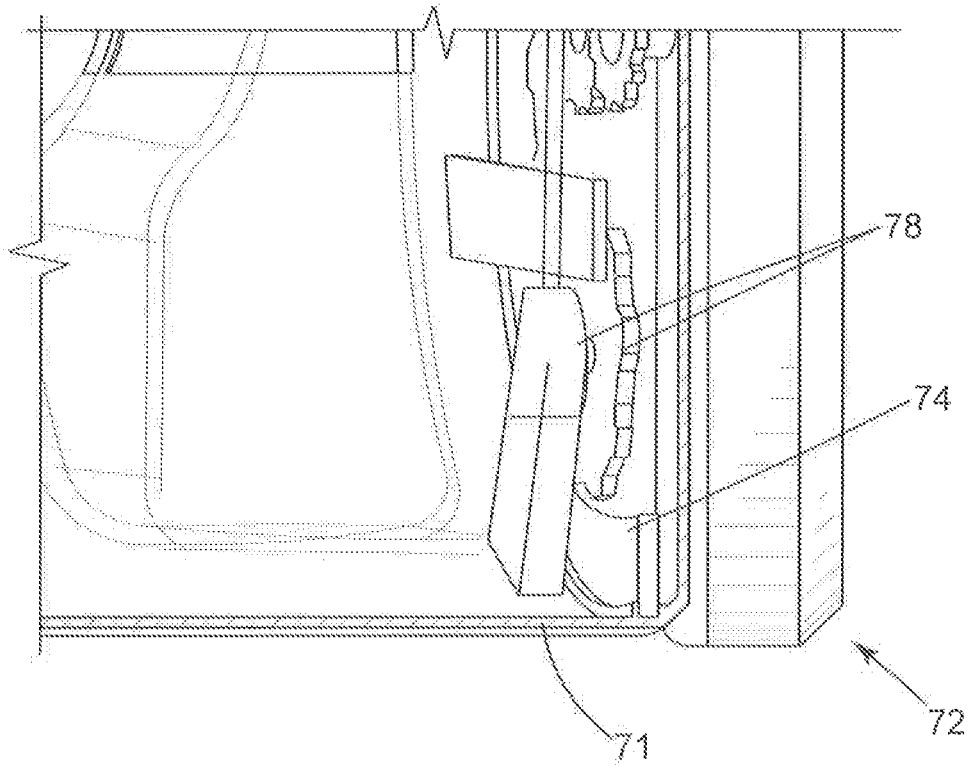

FIG. 25 shows device 70 at the top of its wall-climb at water level, and rotated an additional ninety degrees into its inverted orientation. Again, gear wheel 74 with its weight 77 remain relatively un-rotated while housing 71 and its components have rotated another ninety degrees, with water outlet now facing downward indicated by arrow 88.

Figure 27:
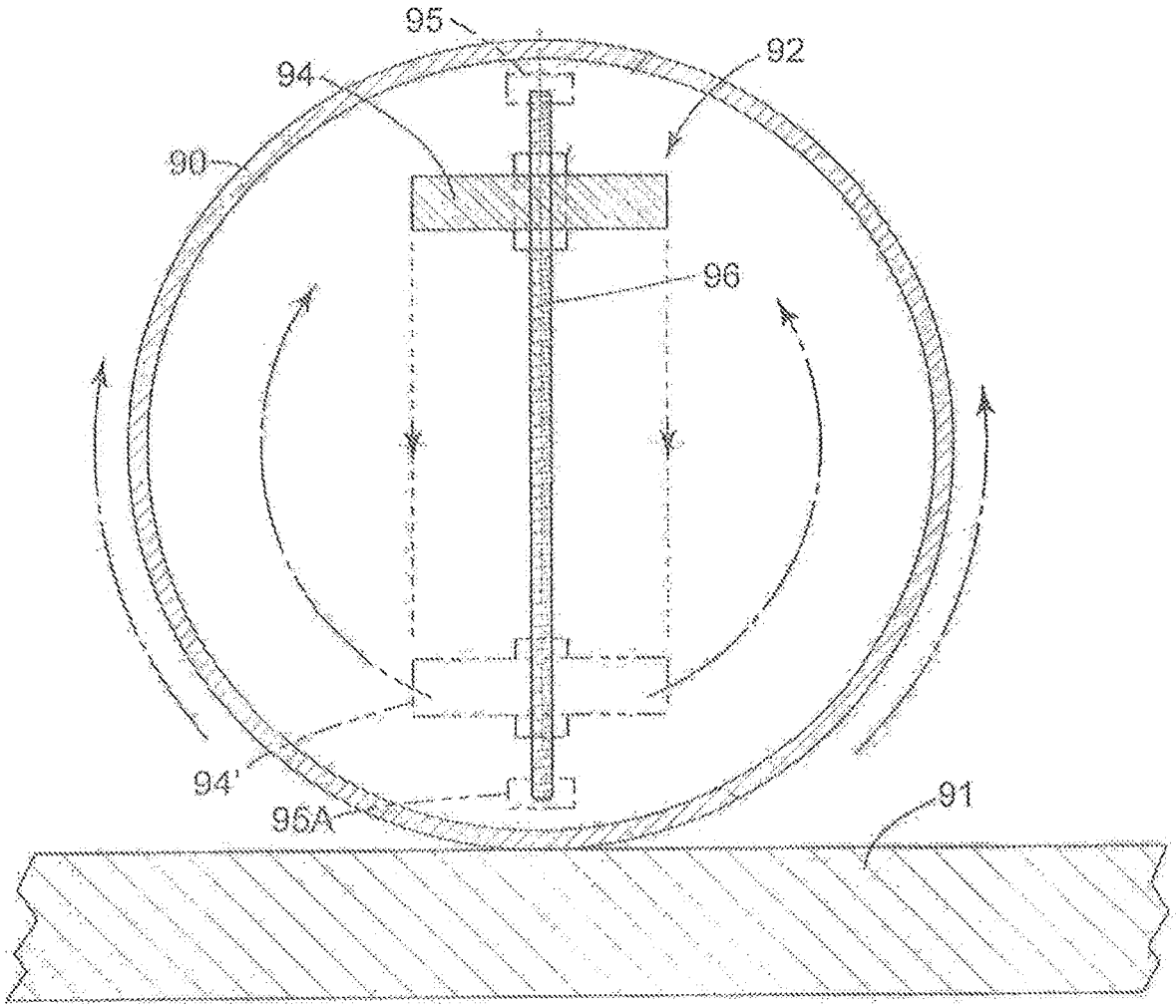
FIG. 27 is a fragmentary schematic end elevation view showing an alternative version of an orientation tipping device within a pool cleaner by moving a buoyant element inside the housing.

Change Pool Cleaner Orientation by Change of Buoyancy. In an alternative embodiment FIG. 27 shows in schematic form an arrangement 92 for causing the pool cleaner housing 90 to rotate ninety degrees or 180 degrees relative to its prior orientation at pool floor 91. This includes an onboard program to alter the location or elevation of a buoyant element 94 within housing 90, from an upper region (see buoyant element in solid black line) to a lower region where buoyant element is shown as 94' in dashed line. Driving buoyant element 94 to its lower position will cause the housing 90 to invert relative to its prior orientation. Electric motor 95 may be axially coupled to threaded rod 96, or motor 95 may be coupled through a worm gear 95A to threaded rod 96. Such movement can be regulated by a timer, or an onboard computer program, or pursuant to the end of a cleaning cycle to a sensed elevation. Alternatively, the pool cleaner can be manually controlled by a cable. While the downward movement of buoyant element 94 is shown schematically as driven by an electric motor coupled to worm gear 95A, many other arrangements to change locations of buoyancy elements within or outside of the housing may be used to alter the buoyancy or center of gravity to achieve tipping and change of the housing's orientation.

The above-described change of orientation by change of buoyancy can be employed for the controller to direct a submerged pool cleaner to invert and rise to the pool water surface where it can proceed in skimmer mode, as follows. In a submerged pool cleaner 10 as seen in FIG. 16 the controller will interrupt electrical power to the water pump, to temporarily interrupt suction of water at the inlet port 18 at the bottom of the cleaner (see FIGS. 8-11) and thus interrupt suction of the pool cleaner toward the pool bottom.

Then, the buoyant element (described above and illustrated in FIG. 14) is directed by the controller to move downward, creating a new center of gravity and inversion of the cleaner housing as seen in FIGS. 12-15. Subsequently, electrical power is restored to the water pump; water is now discharged downwardly through the outlet port 14 (which outlet port was previously situated at the top of the housing). This causes the inverted cleaner to rise to the top surface of the pool water. At the top surface the cleaner can be directed into skimmer mode and/or battery recharging mode.

Figure 30C:
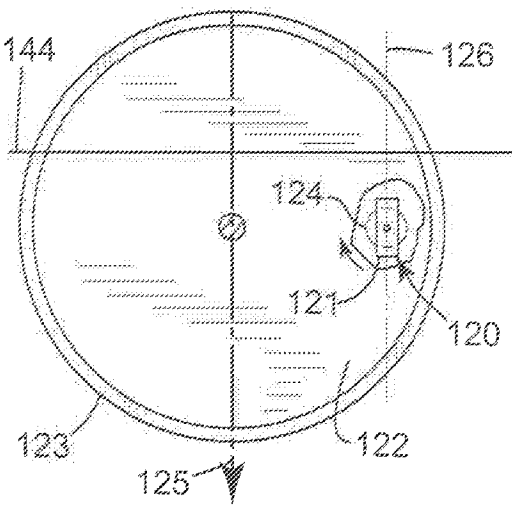
FIGS. 30A, 30B and 30C are schematic views showing how a gyroscope attached to a clean can cause the cleaner housing to pivot from upright to horizontal to inverted.
Figure 30B:
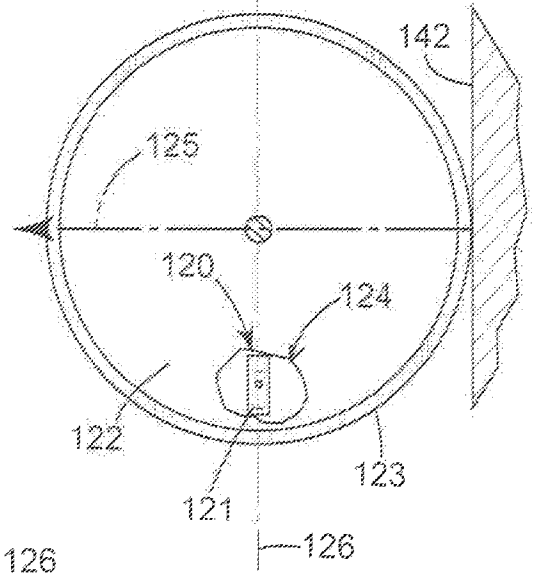
Figure 30A:
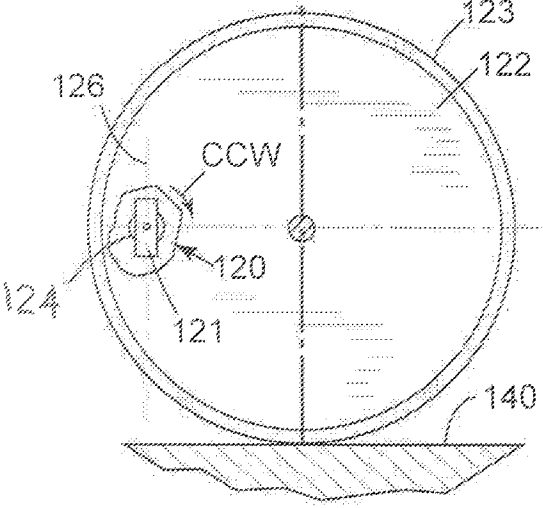
Figure 30A:
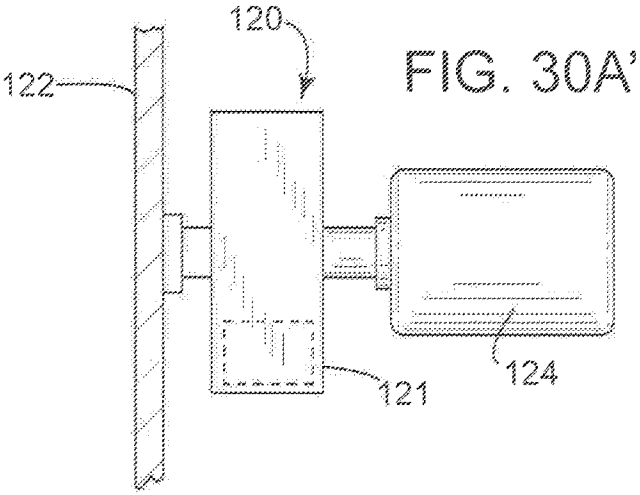
Figure 30A:
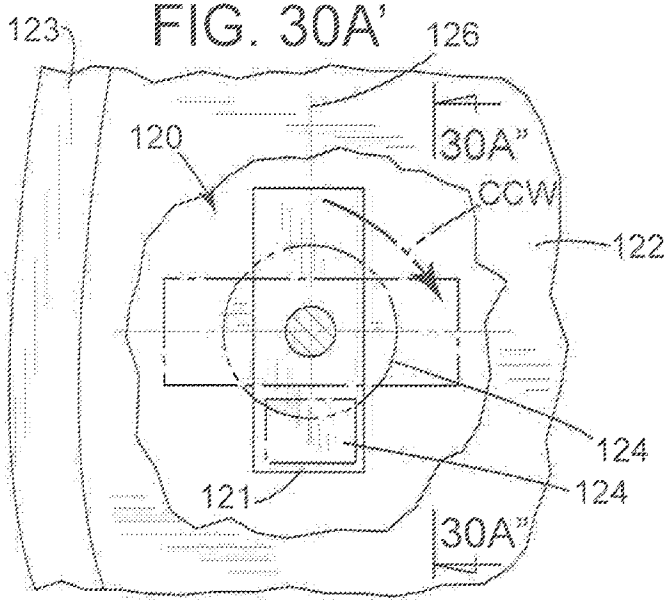

Change Pool Cleaner Orientation with a Gyroscope. FIGS. 30A-30C illustrate schematically the use of a gyroscope 120 to change the orientation of the pool cleaner from upright, then tipped 90° to wall-climbing mode, and then tipped further 90° to an inverted orientation. A gyroscope operates according to well-known principles, where the inertial force from its spinning rotor urges the orientation of its axis of rotation to remain unchanged or to return to its original orientation when the gyroscope frame has been tipped.

FIG. 30A shows pool cleaner 122 having wheels 123, with its water discharge axis 125 oriented upward. Wheels 123 propel housing 122 on the pool floor 140 and later propel the cleaner up a pool wall 142 as indicated in FIG. 30B. FIG. 30A also shows schematically in solid line, gyroscope 120 (not to scale) with its spin axis 126 in a vertical orientation and cleaner in its upright orientation on the pool floor 140. Also in FIG. 30A as shown in dashed line, gyroscope 120 is initially tilted about 45° clockwise as driven by an electric stepper motor 124 (see FIGS. 30A' and 30A"), before it is tilted a full 90° clockwise as seen in dashed line FIG. 30A'. Since the gyroscope is fixed to the cleaner housing, the inertial force of the gyroscope to try to return to its prior orientation will cause the housing to rotate oppositely, counterclockwise. Thus, the clockwise pivoting of the gyroscope causes counterclockwise pivoting of the cleaner housing until the gyroscope spin axis is returned to its original orientation.

In the present embodiment of this invention as seen schematically in FIG. 30A, a gyroscope frame 121 of gyroscope 120 is coupled to the cleaner housing 122. Stepper motor 124 (seen in FIG. 30A') coupled to the gyroscope and directed by a controller (not shown), tips the gyroscope frame 121 ninety degrees clockwise relative to the cleaner housing 122. The gyroscope then urges opposite-direction tipping of the cleaner housing 122 until the gyroscope frame 121 has returned to its original orientation, at which time the cleaner housing has tipped 90 degrees counter-clockwise to wall-climbing mode as seen in FIG. 30B. In actual operation there may be a dynamic relationship of a succession of partial tipping clockwise of the gyroscope followed by partial tipping counter-clockwise of the cleaner, or simultaneous tipping of the gyroscope and cleaner housing, until the cleaner has tipped a full 90 degrees.

FIG. 30B shows the cleaner housing 122 tipped 90° counterclockwise to wall-climbing mode, as further indicated by water pump discharge axis 125 now horizontal. After the cleaner has climbed to water level 144 the stepper motor tips the gyroscope another 90° clockwise and as seen in FIG. 30C cleaner housing 122 is tipped oppositely an additional 90° counterclockwise to its inverted skimming mode with its water pump discharge axis now directed downward.

When the pool cleaner in upright cleaning mode of FIG. 30A approaches or contacts a wall, the housing may include a sensor (not shown) communicating with the controller to direct the gyroscope to tip 90° clockwise to enable the cleaner to tip 90° counterclockwise and begin its climb up the wall. Another onboard sensor (not shown) may communicate to the controller when the cleaner has climbed to water level so that the gyroscope can tip the housing into its inverted skimming mode.

Tip-over of a pool cleaner after a wall-climb to the water line, may also be achieved by simply having a heavy top region in the housing. When such housing reaches the water line and draws in air instead of water, the force from suction urging the housing toward the wall are essentially ended, the top-heavy housing will fall away from the wall resulting in a tipped-over or inverted orientation of the housing. Subsequent return to upright orientation may be established manually by the user or by any of the features described above.

Tip-over and inversion of the pool cleaner from wall-climbing mode may also be achieved by moving air between different air pockets (not shown) in the housing to make the top region more buoyant than the bottom so that the solar panels on the bottom will become exposed at the top. A sensor or timing feature within the onboard computer program may be employed to activate any of the above-described tipping/inverting features. Alternatively, a gravity switch recognizing an inverted state of the housing may switch the pump and/or propulsion system to reduced or pulsating speed until the batteries are re-charged. In a still further embodiment batteries can be recharged by a power cable coupled to an electrical power source outside the pool.

Figure 28:
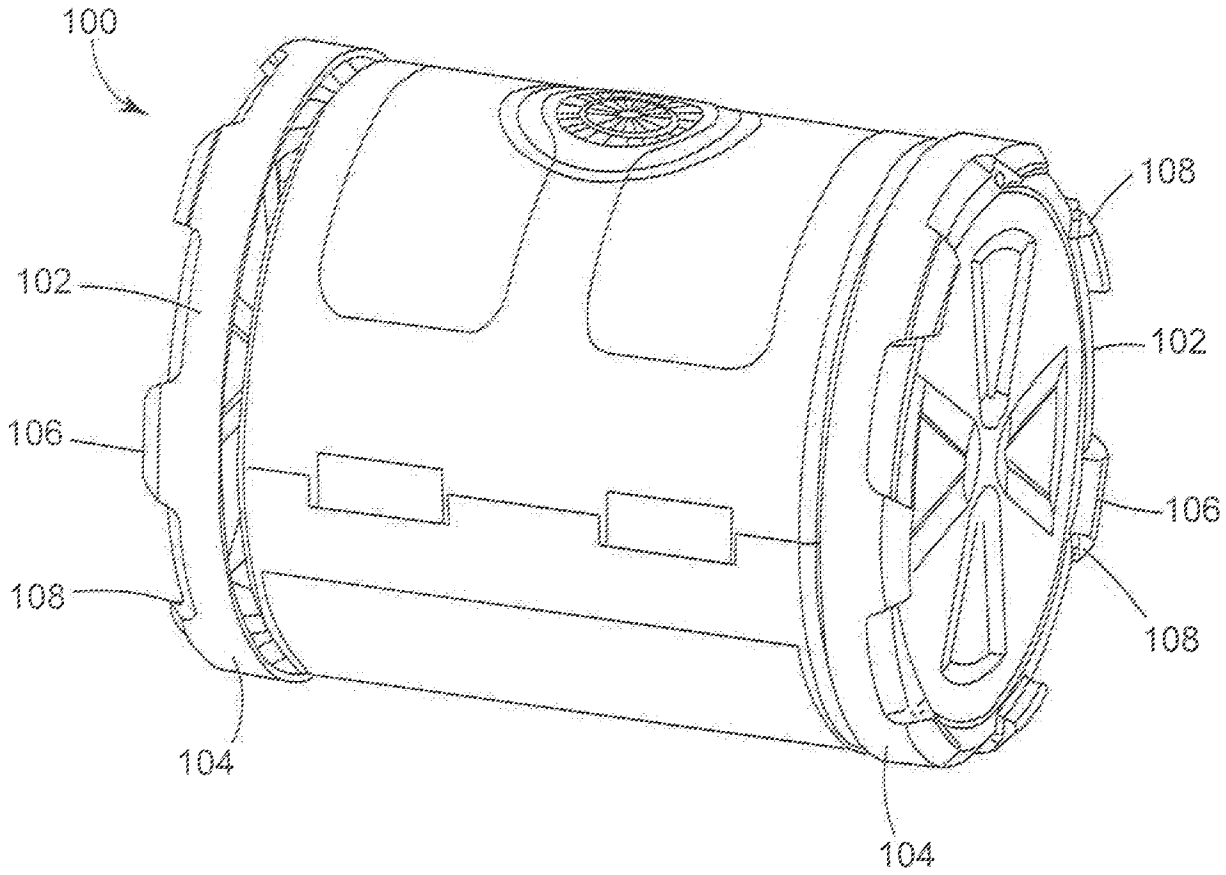
FIG. 28 is a perspective view showing paddle-like protrusions from the wheels for propulsion at top surface of the water.
Figure 29:
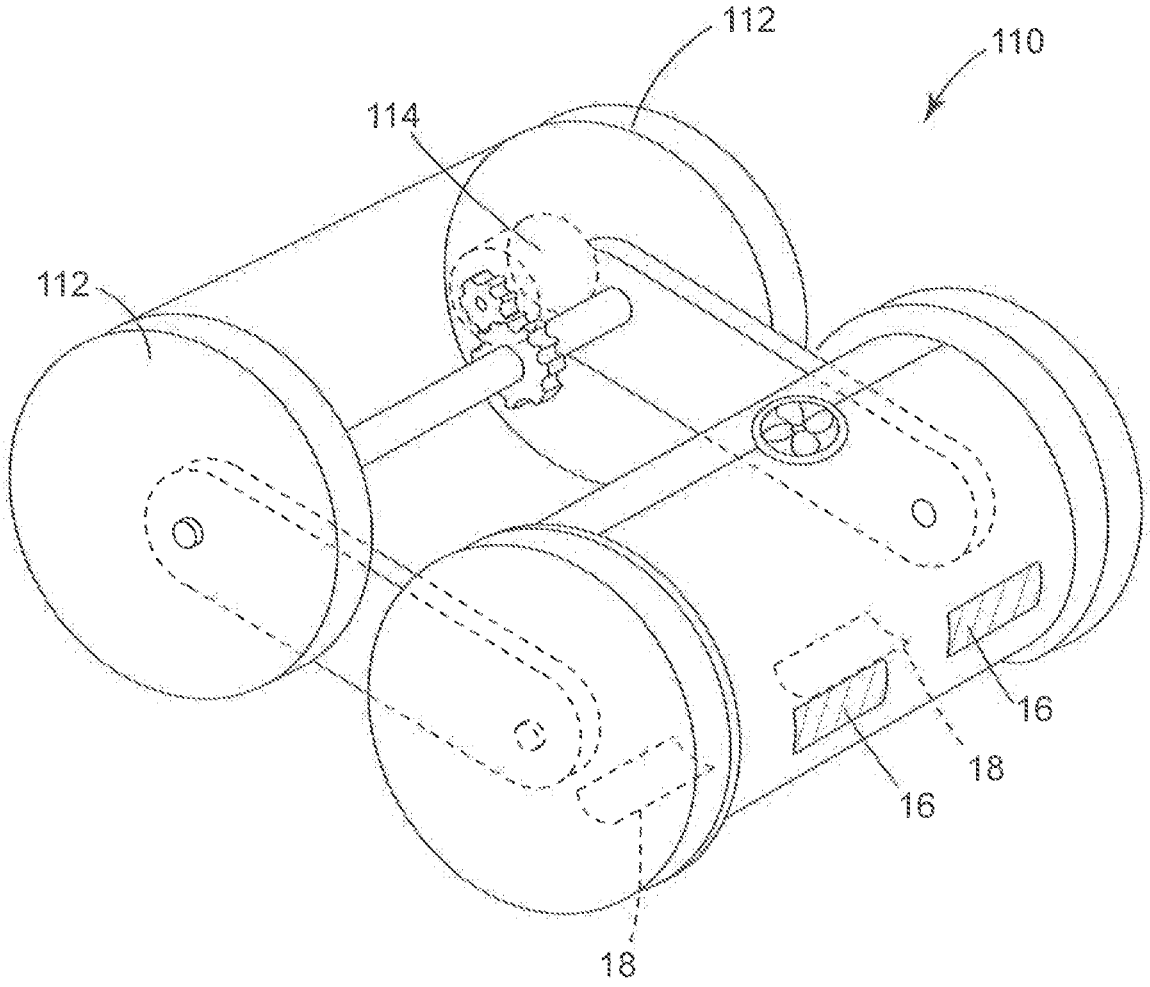
FIG. 29 is a schematic perspective view of a four-wheeled self-propelled robotic pool cleaning device having cleaning, wall-climbing, and inverting capabilities corresponding to those of two-wheeled devices depicted in FIGS. 1-28.

FIG. 29 depicts a four-wheeled version 110 of the present invention, having features that correspond generally to those of the two-wheeled version depicted in FIGS. 1-28. This four-wheeled version has similar water pump, electric motor drives for the water pump and wheels, a rechargeable battery, a programmable controller generally similar to controller 2600 described above, and wall-climbing and inverting capabilities corresponding to those of the earlier-described embodiments. As shown, cleaning device 110 has additional wheels 112 for stability and optimally to provide a powerful propelling where the rear wheels are coupled to an on-board electric motor 114 electrically coupled to a battery and to the controller. This device can take many other forms and arrangements, including employing electric motor 114 and wheels 112 as the sole propelling component.

Dual-Mode Propulsion System

An additional novel concept in the present invention as illustrated in FIG. 28, is a dual-mode propulsion system. As seen in FIG. 28 the pool cleaner device 100 has wheel elements 102 which have typical traction surfaces 104, and also have protrusions 106 spaced around the wheel periphery and extending axially. The protrusions 106 may take many different shapes and sizes, so long as they provide paddle-like propulsion surfaces, as exemplified by edges 108 to push against the pool water as the wheel rotates. At the pool bottom and wall surfaces the wheels provide traction propulsion; at the pool water surface the protrusions have a paddle-like function as the wheels rotate. Propulsion while submerged or at the water surface may be determined by programming the controller 2600 or by more simple reactions to sensors or by manual control by the user.

While the invention has been described in conjunction with several embodiments, it is understood that many alternatives, modifications and variations will be apparent to those skilled in the art in light of the foregoing description. Accordingly, this invention is intended to embrace all such alternatives, modifications and variations which fall within the spirit and scope of the claims.

The invention claimed is:

1. A cleaner configured to travel at least along a bottom surface of a swimming pool, comprising:

a. a housing (i) defining, at least while travelling along the bottom surface of the swimming pool, (A) a lower surface adjacent the bottom surface, (B) a side surface, and (C) an upper surface and (ii) having a first water intake port in the lower surface, a second water intake port in the side surface, and a water discharge port;

b. means for opening and closing each of the first and second water intake ports independently of the other of the first and second water intake ports; and c. rotationally-mounted supports configured to propel the housing within the swimming pool.

2. A cleaner according to claim 1 in which the means for opening and closing each of the first and second water intake ports independently of the other of the first and second water intake ports comprises:

a. a first port door associated with the first water intake port; and b. a second port door associated with the second water intake port.

3. A cleaner according to claim 2 in which the means for opening and closing each of the first and second water intake ports independently of the other of the first and second water intake ports further comprises a controller.

4. A cleaner according to claim 3 in which the controller is an onboard programmable micro-controller.

5. A cleaner according to claim 4 further comprising means for opening and closing the water discharge port.

6. A cleaner according to claim 4 further comprising a filter in fluid communication with the first and second water intake ports and the water discharge port.

* * * * *